US007523953B2

(12) United States Patent
Ettlinger et al.

(10) Patent No.: US 7,523,953 B2
(45) Date of Patent: Apr. 28, 2009

(54) ALPINE SKI BINDING SYSTEM HAVING RELEASE LOGIC FOR INHIBITING ANTERIOR CRUCIATE LIGAMENT INJURY

(75) Inventors: Carl F. Ettlinger, Underhill Center, VT (US); David J. Dodge, Williston, VT (US)

(73) Assignee: Vermont Safety Developments, Underhill Center, VT (US)

( * ) Notice: Subject to any disclaimer, the term of this patent is extended or adjusted under 35 U.S.C. 154(b) by 0 days.

(21) Appl. No.: 11/834,041

(22) Filed: Aug. 6, 2007

(65) Prior Publication Data

US 2008/0036180 A1 Feb. 14, 2008

Related U.S. Application Data

(60) Provisional application No. 60/836,454, filed on Aug. 8, 2006.

(51) Int. Cl.

| | |
|---|---|
| ***A63C 9/00*** | (2006.01) |
| ***A63C 9/08*** | (2006.01) |
| ***A63C 9/081*** | (2006.01) |
| ***A63C 9/082*** | (2006.01) |

(52) U.S. Cl. ..... 280/617; 280/611; 280/613; 280/614; 280/615; 280/DIG. 13; 280/618; 280/623; 280/626; 280/627; 280/628; 280/629; 280/14.23; 280/14.24

(58) Field of Classification Search ..... 280/611, 280/613, 614, 615, 616, 617, 618, 623, 626, 280/627, 628, 629, 14.23, DIG. 13, 14.24
See application file for complete search history.

(56) References Cited

U.S. PATENT DOCUMENTS

| | | | | |
|---|---|---|---|---|
| 3,091,475 | A | 5/1963 | Wunder | |
| 3,876,218 | A * | 4/1975 | Von Besser | 280/618 |
| 5,064,215 | A | 11/1991 | Ferdinand et al. | |
| 5,071,155 | A | 12/1991 | Stepanek et al. | |
| 5,551,720 | A | 9/1996 | Ruffinengo | |
| 5,722,681 | A | 3/1998 | Merino | |
| 6,007,086 | A * | 12/1999 | Hopkins | 280/612 |
| 6,450,526 | B1 | 9/2002 | Bressand | |
| 7,063,345 | B2 | 6/2006 | Holzer | |
| 7,086,662 | B2 | 8/2006 | Dodge | |
| 2004/0145154 | A1 * | 7/2004 | Holzer | 280/611 |
| 2004/0173994 | A1 | 9/2004 | Howell | |

OTHER PUBLICATIONS

International Search Report of related International Application No. PCT/US07/75334 dated Aug. 22, 2008.

(Continued)

*Primary Examiner*—Christopher P Ellis
*Assistant Examiner*—John R Olszewski
(74) *Attorney, Agent, or Firm*—Downs Rachlin Martin PLLC

(57) ABSTRACT

An alpine ski binding system for releasably securing a ski boot to a ski. The binding system includes a secondary toe release that provides an attenuated release threshold under lateral shear loading conditions that can cause anterior cruciate ligament injuries. The secondary toe release responds to a trigger that senses the lateral shear loads applied to the inside (medial) afterbody of the ski and triggers the secondary toe release the boot at an attenuated release torque. Lateral shear loads applied to the ski along the leading (medial) forebody and along the entire outside (lateral side) of the ski substantially do not cause the trigger to trip.

61 Claims, 22 Drawing Sheets

OTHER PUBLICATIONS

Gordon Lipe, The ALLSOP-Pegged for Safety, Know Your Binding: 18, Ziff-Davis Publishing Company, Oct. 1973.

Gordon Lipe, The Allmat 8000, Jet, and PSC, Know Your Bindings: 19, Nov. 1973, pp. 155, 158 and 163.

Gordon Lipe, The Americana: Heel Release on a Plate, Know Your Bindings: 21, pp. 12-14, published prior to Aug. 7, 2005.

Carl Ettlinger, Bindings Performance Report: The Salomon 727, Reprinted from Skiing Magazine, Oct. 1978, Ziff-Davis Publishing Company.

Carl Ettlinger, Bindings Performance Report: The Moog Delta S, Reprinted from Skiing Magazine, Nov. 1978, Ziff-Davis Publishing Company.

Carl Ettlinger, Bindings Performance Report: The Burt II, Reprinted from Skiing Magazine, Dec. 1978, Ziff-Davis Publishing Company.

Carl Ettlinger, Bindings Performance Report: The Tyrolia 60 Series, Reprinted from Skiing Magazine, Oct. 1979, Ziff-Davis Publishing Company.

Carl Ettlinger, Bindings Performance Report: The New Spademan Line, Reprinted from Skiing Magazine, Dec. 1979, Ziff-Davis Publishing Company.

Carl Ettlinger, Bindings Performance Report: Look Again, Reprinted from Skiing Magazine, Feb. 1983, Ziff-Davis Publishing Company, pp. 109-111.

Carl Ettlinger, How Your Bindings Work, Marker's Twincam Series, Skiing, Oct. 1987, pp. 225, 228, 230.

Carl Ettlinger, How Your Bindings Work, The Ess V.A.R., Skiing, Feb. 1988, pp. 94, 116.

Carl Ettlinger, The New Geze Line, Skiing, Oct. 1988, pp. 190, 192, 194.

Carl Ettlinger, The Salomon '37 Line, Skiing, Nov. 1982, pp. 175, 176, 178, 180.

* cited by examiner

ALPINE SKI BINDING SYSTEM HAVING RELEASE LOGIC FOR INHIBITING ANTERIOR CRUCIATE LIGAMENT INJURY

RELATED APPLICATION DATA

This application claims the benefit of priority of U.S. Provisional Patent Application Ser. No. 60/836,454, filed Aug. 8, 2006, and titled "Knee-Friendly Ski Binding," which is incorporated by reference herein in its entirety.

FIELD OF THE INVENTION

The present invention generally relates to the field of alpine ski bindings. In particular, the present invention is directed to an alpine ski binding system having release logic for inhibiting anterior cruciate ligament injury.

BACKGROUND

Sprains and other injuries of the anterior cruciate ligament (ACL) of the human knee are painful, debilitating, and expensive and time consuming to repair and rehabilitate. In skiing, the incidence of ACL injury began to rise in the late 1970s to become the sport's most common serious injury by the late 1980s. Since the early to mid 1990s the risk of sustaining this injury has stabilized and then declined modestly. However, at 15% to 20% of all ski-related injuries, it still remains the most common injury, with more than 20,000 per year in the U.S. alone. From 1983 on, changes in the incidence of ACL injury have been tracked by a series of "Trends" papers published as Special Technical Publications (STPs) by the American Society for Testing and Materials (ASTM).

In October, 1995, the American Journal of Sports Medicine published a paper titled "A Method To Help Reduce The Risk Of Serious Knee Sprains Incurred In Alpine Skiing." The paper documented the results of a training program for on-slope ski-area employees at 20 ski areas in the U.S. and compared injury rates for the group with both a historical control group (the same ski areas for the two prior seasons) and an ad hoc control group of 20 ski areas that had not yet joined the training regime. The training involved a highly structured, video-based discussion format. Actual footage of ACL injuries was used to create a kinesthetic awareness of the events leading to the most common types of ACL injury. The program reported a 62% reduction in ACL injuries overall, and for ski patrollers, the highest risk subgroup, the reduction was 76%. This program identified the "phantom foot" scenario as the most likely mechanism of ACL injury. In this scenario the skier is off-balance to the rear with most of the weight on the downhill (outside) ski.

In later studies published in ASTM STPs, it was shown that the equipment associated with ACL injuries was comparable in quality and overall release performance to the equipment of the general population at risk but superior in every quality to equipment associated with sprains and fractures below the knee. These studies show that contemporary ski bindings, regardless of their condition, are not capable of reducing the risk of ACL injuries.

SUMMARY OF THE DISCLOSURE

One aspect of the present invention is a ski binding configured to be secured to a snow ski and selectively retain a ski boot having a heel and a toe and worn by a skier having a tibial axis, the snow ski having a first-quadrant edge, a second-quadrant edge, a third-quadrant edge, a fourth-quadrant edge and a trailing end, the ski binding comprising: a heel piece for releasably engaging the heel of the ski boot; a toe piece for releasably engaging the toe of the ski boot, wherein the toe piece and the heel piece provide the ski binding with a non-attenuated release torque about the tibial axis of the skier when: the ski binding is mounted to the snow ski; the skier is wearing the ski boot; and the ski boot is properly captured in the ski binding; and release logic providing the ski binding with an attenuated release torque about the tibial axis in response substantially only to a lateral shear force being applied to the snow ski at a location along the third-quadrant edge.

Another aspect of the present invention is a ski binding system configured to be secured to a snow ski and selectively retain a ski boot having a heel and a toe and worn by a skier having a tibial axis, the snow ski having a first-quadrant, a second-quadrant, a third-quadrant, a fourth-quadrant and a trailing end, the ski binding system comprising: an attenuated release logic mechanism for being secured to the snow ski and being configured to fixedly receive a heel piece and a toe piece, the attenuated logic mechanism including: a secondary toe release for providing, when the ski binding system is secured to the snow ski, the heel and toe pieces are fixedly secured to the attenuated release logic mechanism, and the ski boot is properly engaged between the heel and toe pieces: an attenuated release in response to lateral shear loads applied to the snow ski in the third-quadrant of the snow ski; and a non-attenuated release in response to lateral shear forces applied to the snow ski in the fourth-quadrant of the snow ski; a trigger operatively configured, when the ski binding system is secured to the snow ski, to trigger the secondary toe release to switch from the non-attenuated release to the attenuated release in responses to a triggering third-quadrant shear force.

Still another aspect of the present invention is a method of releasing a ski boot from an alpine ski binding system, comprising: sensing lateral shear forces applied to a snow ski having a first-quadrant, a second-quadrant, a third-quadrant and a fourth-quadrant; determining when a virtual net shear force present in the third-quadrant exceeds a threshold value; in response to the net virtual shear force applied to the snow ski in the third-quadrant exceeds the threshold value, triggering a secondary toe release; and releasing via the secondary toe release the ski boot from the binding system.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
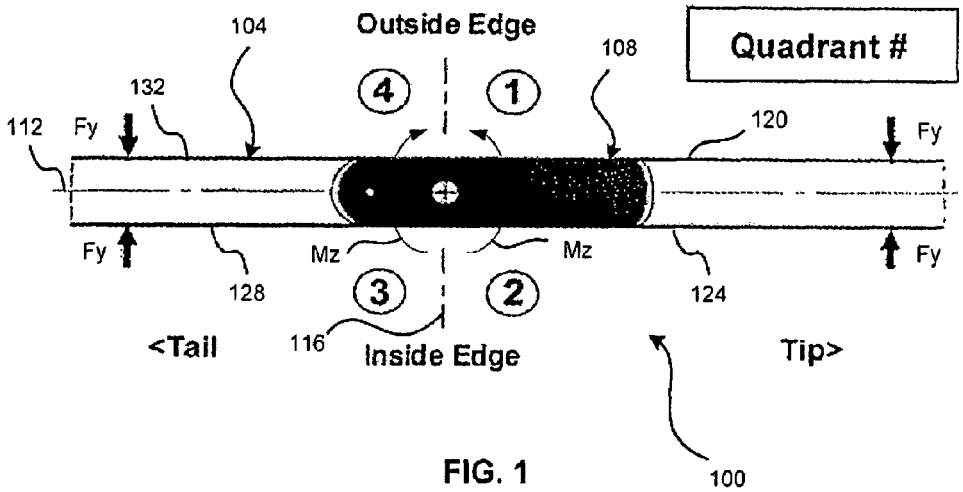
FIG. 1 is a partial top view of a conventional left-leg ski illustrating conventions used in the present disclosure.

The present disclosure is directed to an alpine ski binding system having release logic configured to have an attenuated release torque when a shear force is applied to the medial side of the ski, rearward of the tibial axis of the leg of a skier. As discussed below, this region is denoted for convenience "quadrant 3," "Q3," "third quadrant," or a like term. During skiing maneuvers there are many lateral shear forces acting simultaneously along the physical edge of the ski as well as inertial forces between the various masses of the skier and his equipment that generate lateral shear forces between the boot and binding. All these lateral shear forces can be resolved to one virtual force at one location along a virtual, infinitely long, ski plus a couple (pure torque). In the discussion below any references to "shear force" are meant to describe this virtual force acting on a virtual ski. As mentioned in the Background section above, it is believed that certain third-quadrant loadings, when applied to skiers' legs via current generation bindings, are frequently implicated in injuries to the skiers' anterior cruciate ligaments (ACLs). The studies cited in the Background section above, careful analysis of video footage of skiers as ACL injuries occurred, tests of contemporary release bindings, results of skier strength in near ACL postures and measurements of the loads applied to a ski during actual skiing maneuvers have led the present inventors to develop a computer model for a ski binding with selective release characteristics and working prototypes of several examples of the underlying principles of the present disclosure, which are discussed below. The computer model uses a coordinate system based on FIG. X1.4 of the Appendix to ASTM Test Method F504 and creates a partial release envelope as described in that Appendix. (ASTM Test Method F504 and its Appendix are incorporated herein by reference in their entireties.) Using the computer model, the present inventors can shape the release envelope to accommodate the retention requirements of skiers so that a narrow but predictable margin of retention is provided in the area of the envelope associated with the most common mechanism of ACL injury.

An alpine ski binding system of the present disclosure provides a reduced retention in areas of the release envelope that may influence ACL injury. Such a binding system creates a depression in the portion of the release envelope most likely to be associated with ACL injury. The location of the depression and the magnitude of its effect are adjustable, as described in more detail below. To the best of the present inventors' knowledge, no one has yet devised a binding having release logic designed to provide a reduced release threshold (relative to contemporary conventional bindings that have a fixed release threshold regardless of the location of the shear load on the ski) only when the net shear force on the ski resolves to a load in the third quadrant. With such a reduced third-quadrant release threshold, a binding made in accordance with the present disclosure can advantageously release before a skier's ACL is put at risk of injury. As seen below, such release threshold logic may be implemented in a number of ways using various mechanisms and/or electronics. In addition, with these mechanisms and/or electronics, the release envelope for third-quadrant loadings can be shaped to accommodate the retention requirements of skiers so that a narrow but predictable margin of retention is provided in the area of the envelope associated with the most common mechanism of ACL injury. However, prior to describing several ski binding systems that include unique release-threshold logic, it is beneficial to understand the release-threshold profile of most current ski bindings.

Referring now to FIG. 1, this figure illustrates a naming convention used throughout the following disclosure and in the appended claims. FIG. 1 shows a ski system 100 that includes a left ski 104 having a boot region 108 that receives a ski boot (not shown) during use of the ski. The dark boot region 108 represents the area of ski 104 confronted or overlain by the sole of the ski boot when the boot is properly engaged in a binding (not shown) affixed to the ski. In this figure, the tail end of ski 104 is located out of the view of the figure to the left along longitudinal central axis 112 of the ski, and the leading tip of the ski is located out of the view of the figure and to the right along longitudinal central axis 112. It should be noted that quadrants 1 and 2 extend to infinity beyond the tip of the ski and quadrants 3 and 4 extend to infinity beyond the tail of the ski. While not shown, those skilled in the art can readily envision the heel and toe pieces of a conventional alpine binding being generally located, respectively, to the immediate left and right of boot region 108. The location of the longitudinal central axis of a skier's tibia bone (i.e., tibial axis) along ski 104 is represented by dashed line 116.

For convenience, left ski 104 is parsed into four shear loading quadrants, i.e., quadrants 1 through 4, with tibial axis 116 and longitudinal central axis 112 demarcating the differing quadrants. Each net resolved lateral shear force (or "virtual" force) (Fy) applied in a corresponding quadrant 120, 124, 128, 132 of ski 104 and the corresponding moment (Mz) this force causes at tibial axis 116 are related by the basic equation, Force times Distance equals Torque. Here, the Force is the net resolved lateral shear force Fy, the Distance is the distance of shear force Fy from tibia axis 116 and the Torque is the tibial moment Mz.

Forces on ski 104 during skiing in each quadrant 1-4 produce a unique combination of force Fy and moment Mz at tibial axis 116, i.e., on the leg of the skier. A ski binding system made in accordance with the present invention is designed to recognize when loads on a ski are in quadrant 3 and respond by enabling release of the ski binding at a lower than normal release torque, as represented here as tibial moment Mz. In the following FIGS. 2-5, 7 and 8, the twisting moment Mz on the leg is expressed in terms of "(%) of Recommended," as defined by section 5 of ASTM standard F939, "Selection of Release Torque Values for Alpine Ski Bindings," which is incorporated herein by reference in relevant part. While only the left ski 104 of a pair of skis is shown, it will be readily appreciated that for consistency of the noted convention, the convention for the right ski (not shown) would be a mirror image of the convention shown for the left ski about a line (not shown) parallel to longitudinal central axis 112 and spaced from the left ski. That is, quadrants 1 and 4 would be located on the outside (lateral side) of the right ski when worn by a skier, and quadrants 2 and 3 would be located on the inside (medial side) of the right ski.

Figure 2:
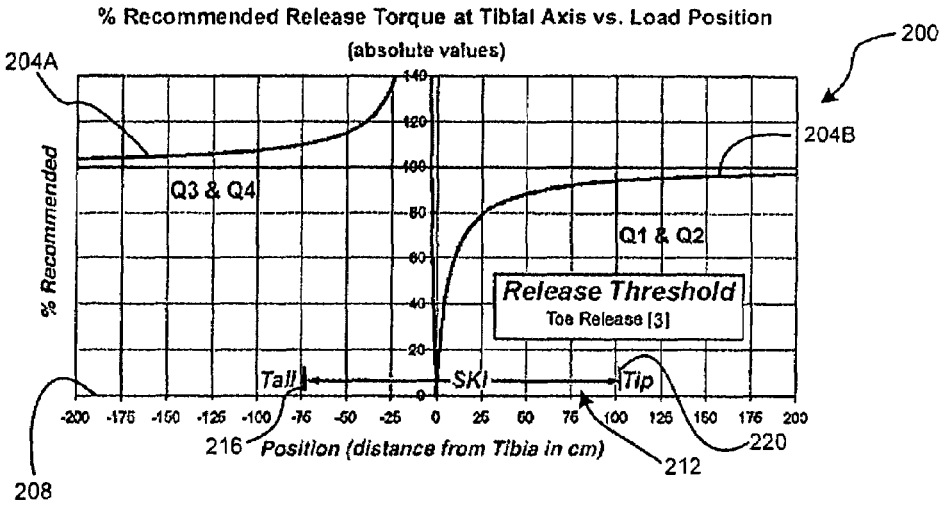
FIG. 2 is a graph of a theoretical release envelope, as seen relative to the tibial axis of a skier's leg, illustrating release/retention characteristics typical of a contemporary conventional ski binding having a binding pivot point located between the heel piece and the tibial axis of the skier's leg.

FIG. 2 is a graph 200 of a release envelope 204A-B, as seen by a skier's leg, of a conventional "toe release" type alpine ski binding having a binding pivot point at the center of the radius of the heel piece, here 6.6 cm behind the tibial axis of the skier. Again, graph 200 is of the type shown in ASTM F504, FIG. X1.4 and relates torque (Mz of FIG. 1) about the reference axis of the leg (here, tibial axis 116 of FIG. 1) at release to the position of the single force (Fy of FIG. 1) on the ski that creates that torque. The "Position" (i.e., the horizontal axis 208) in FIG. 2, and in FIGS. 2-5, 7 and 8, refers to the virtual position of the single force Fy on an infinitely long ski that replaces all loads on the finite ski and produces the moment Mz. Here, position is measured from the tibial axis of the skier's leg. In the graph 200 of FIG. 2, as well as in the graphs 300, 400, 600 of FIGS. 3, 4 and 6, respectively, virtual "position" is plotted from (−)200 cm to +200 cm from the tibial axis, which is located at "0" on the horizontal axes of the corresponding respective graphs. Changes in the tibial moment Mz beyond these distances along the virtual ski are small in comparison to changes within these distances. The relationship of this virtual ski to an actual typical ski can be seen by the representation 212 of a ski placed in proper relation to the tibial axis, with the tail and tip of the ski being indicated by vertical lines 216, 220, respectively.

In conventional binding designs, the release envelope of the ski binding about the binding's pivot axis, which in the example is at the center of the heel radius 6.6 cm behind the tibial axis, is symmetrical in all four quadrants Q1-Q4. However, as seen in FIG. 2 the release torque on the skier's leg as indicated by release envelope portion 204A is much higher for loads applied to the after body of the ski than release envelope portion 204B for loads applied to the fore body of the ski. The reason for this difference is the offset (here, 6.6.cm) in the location of the binding pivot axis from the location of the tibial axis. That said, it is readily seen from after-body release envelope portion 204A that the release envelope is symmetrical for loadings in quadrants Q3 and Q4 and from fore-body release envelope 204B that the release envelope is symmetrical for loadings in quadrants Q1 and Q2.

Figure 3:
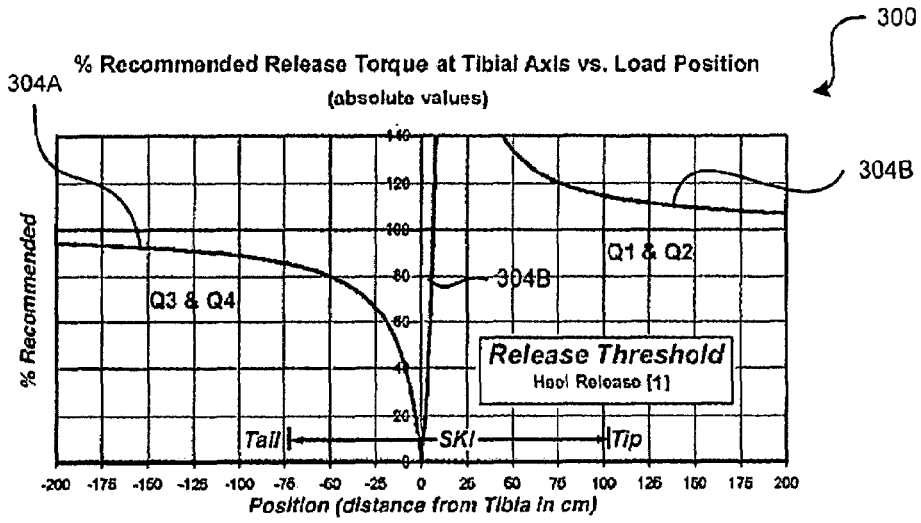
FIG. 3 is a graph of a theoretical release envelope, as seen relative to the tibial axis of a skier's leg, illustrating release/retention characteristics typical of a contemporary conventional ski binding having a binding pivot point located between the tibial axis of the skier's leg and the toe of the ski boot.
Figure 4:
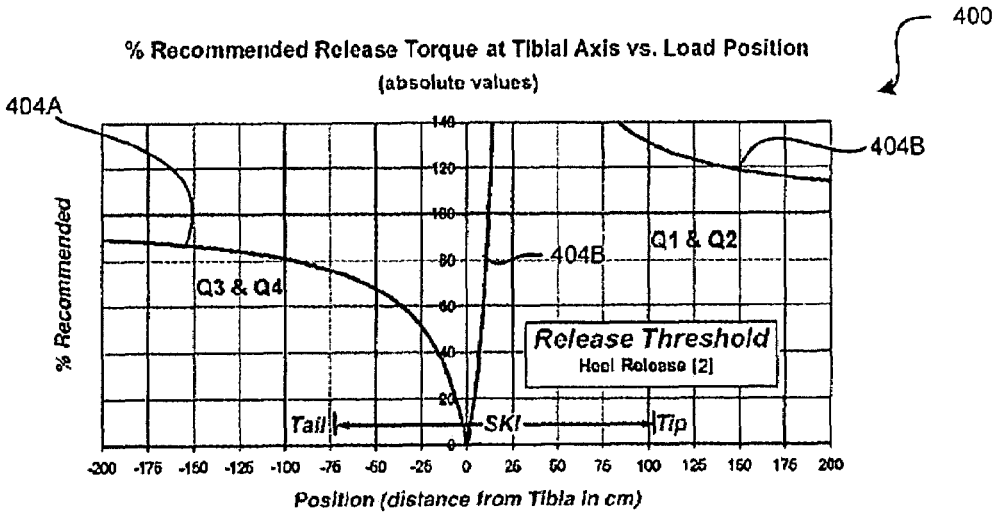
FIG. 4 is a graph of a theoretical release envelope, as seen relative to the tibial axis of a skier's leg, illustrating release/retention characteristics typical of a contemporary conventional ski binding having a binding pivot point located forward of the toe of the ski boot.

Whereas FIG. 2 shows graph 200 for a conventional toe release type ski binding, FIGS. 3 and 4 illustrate graphs 300, 400, respectively, for two contemporary heel release type ski bindings. In FIG. 3, the binding has a pivot axis located forward of the tibial axis ("0" on the horizontal axis of graph 300) but behind the boot toe, and in FIG. 4, the binding has a pivot axis located forward of the boot toe. As seen from each of envelopes 304A-B (FIG. 3) and 404A-B, the release torques on the leg are symmetrical for after body loadings in quadrants Q3 and Q4 and for fore body loadings in quadrants Q1 and Q2. In each of the examples of FIGS. 2-4, the binding senses the same torque at release with respect to its own pivot axis, while the skier's leg, which has a different reference axis, senses a release torque that is dependent on the position of the load on the ski. It is noted that the foregoing analyses ignore the effects of friction and combined loading that may influence individual bindings in actual skiing.

Each of the above graphs 200, 300, 400 of FIGS. 2-4, respectively, demonstrates a different problem. The toe release type binding of FIG. 2 fails to sense the true load on the skier's leg in quadrant Q3. The heel release type binding of FIG. 3 fails to sense the true load on the skier's leg in quadrant Q1 and Q2. Although the binding of FIG. 3 does lower the release threshold in quadrant Q3, it does not lower it sufficiently near the tail of the ski, which is the area of greatest risk to the ACL. The other heel release type binding of FIG. 4 demonstrates the same problems as the binding of FIG. 3. Although it does lower the release threshold in quadrant Q3 more than the binding of FIG. 3, the improvement is insufficient. Bindings of this type also lack an adequate margin of retention in response to loads applied to the after body of the ski near the tibial axis.

Figure 5:
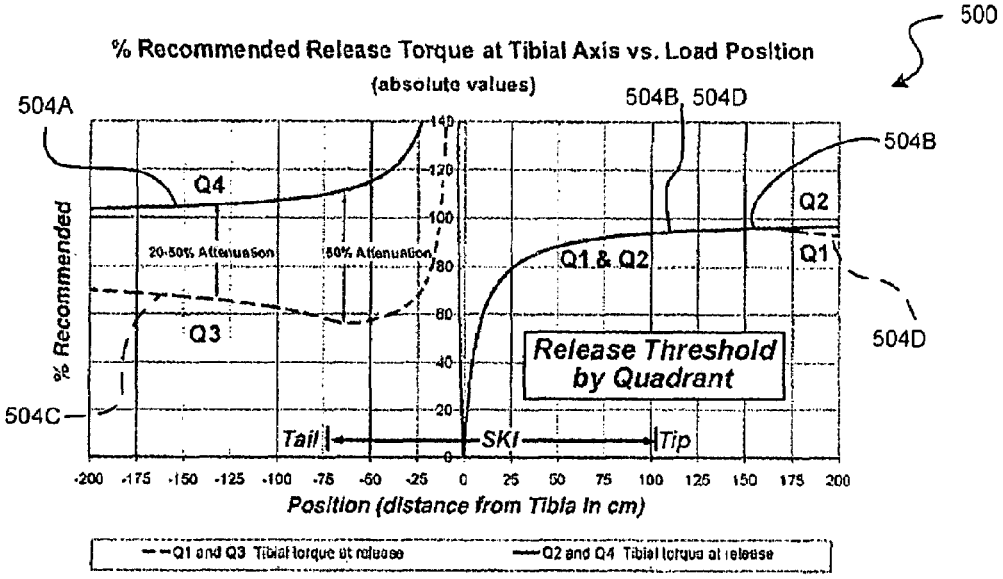
FIG. 5 is graph of a theoretical release envelope, as seen relative to the tibial axis of a skier's leg, illustrating release/retention characteristics typical of a ski binding system having a third-quadrant attenuated secondary toe release.
Figure 6:
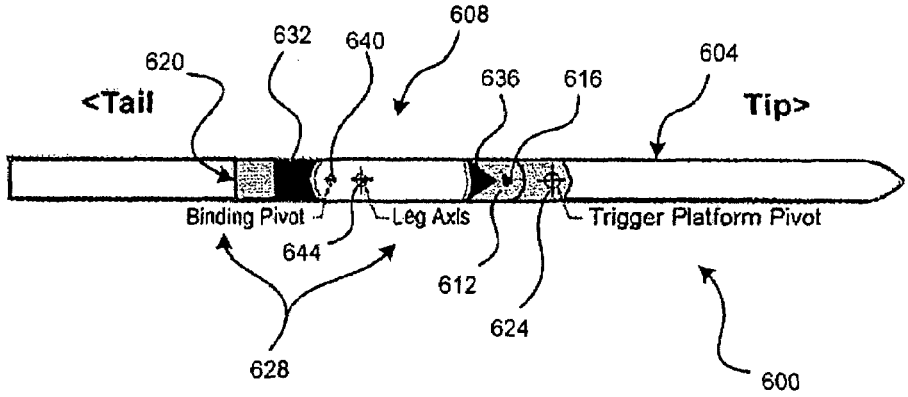
FIG. 6 is a top view/diagrammatic view of an exemplary ski system having the theoretical release envelope of FIG. 5.

In contrast to graphs 200, 300, 400 of FIGS. 2-4, respectively, FIG. 5 contains a graph 500 illustrating a release envelope 504A-D achievable using a ski system made in accordance with the present invention. As seen in FIG. 5, the ski system is able to distinguish loads applied in quadrant Q3 and provide an attenuated release (represented by release envelope portion 504C) relative to the non-attenuated release (represented by release envelop 504A) relative to loads applied in quadrant Q4. As is readily seen by comparing graph 500 to graph 200 of FIG. 2 for a conventional toe release type binding, it is seen that release envelope portions 504A-B are nearly identical to release envelope 204A-B of FIG. 2. In this case, this is so because graph 500 of FIG. 5 is based on a ski system that utilizes the conventional toe release type binding of graph 200 of FIG. 2. However, it is seen from FIG. 5 that augmentations made to such a conventional binding in the exemplary ski system used to generate graph 500 provide the ski system with an attenuated release envelope portion 504C for loads in quadrant Q3, which appears to be the quadrant most implicated in ACL injury. Release envelope portion 504D for a small portion of quadrant Q1 is an artifact of the configuration of the particular ski system used to generate graph 500. FIG. 6 illustrates an alpine ski system 600 that can be used to achieve release envelope 504A-D of FIG. 5.

Referring now to FIG. 6, and also to FIG. 5, FIG. 6 shows ski system 600 as including a ski 604 and a binding system 608. Binding system 608 includes, in this example, a pivotable secondary toe release 612 pivotable about a pivot axis 616 and a pivotable trigger, here a trigger platform 620, pivotable about a pivot axis 624. Binding system 608 also includes a toe release type boot binding 628 that includes a heel piece 632 and a toe piece 636 and has a binding pivot axis 640 close to the heel piece. Not shown, but readily envisioned as being captured between heel and toe pieces 632, 636, is a ski boot, which may be a conventional ski boot. Also shown for context is the location of the tibial axis 644 of a skier when ski system 600 is properly secured to the skier's boot. Graph 500 of FIG. 5 was created using ski system 600 as a model and using the particular input and calculated values shown in the following table.

| Input Values for Example Calculations | | |
|---|---|---|
| Ski Length | 175.0 | cm |
| Ski Tip length | 14.0 | cm |
| Ski Tail Length | 5.0 | cm |
| Boot Length | 30.3 | cm |
| Boot Heel to Binding Pivot | 3.5 | cm (+ forward − rearward) |
| Boot Heel to Tibial Axis | 10.1 | cm (+ forward − rearward) |
| Boot Toe to Plate pivot | 7.5 | cm (+ forward − rearward) |
| Release Torque | 100 | % of recommended release torque |
| Plate Trip Torque | 80 | % of recommended release torque |
| Release Attenuation | 50 | % of recommended release torque |
| Calculated Values: | From tibial axis | |
| Tail | −72.9 | cm |
| End of running surface | −67.9 | cm |
| Mid running surface | 10.1 | cm |
| Boot Heel | −10.1 | cm |
| Boot Toe | 20.2 | cm |
| Binding pivot | −6.6 | cm |
| Tibial axis | 0.0 | cm |
| Plate pivot | 27.7 | cm |
| Start of surface | 88.1 | cm |
| Tip | 102.1 | cm |

In ski system 600 of FIG. 6, distinguishing quadrant Q3 loads is accomplished by isolating the boot and binding 628 from ski 604 by means of trigger platform 620 that pivots about pivot axis 624 forward of tibial axis 644. In this example, pivot axis 624 of trigger platform 620 is also located forward of the toe of the ski boot. The performance of binding system 608 is controlled by a number of factors, including the location of the trigger platform pivot axis 624, the location of the binding pivot axis 640, the nominal release torque setting, the trigger platform trip torque setting, and the release attenuation setting. Until trigger platform 620 senses the trip torque specified in the table above, binding 628 functions in its primary release mode. However, once the specified trip torque is reached, trigger platform 620 enables an attenuated release when the torque specified in Table 1 is reached (FIG. 5). Therefore the logic for a secondary release of the present invention requires two criteria to be met before release can take place. For ACL protection, this capability is limited to quadrant Q3. Although a small effect is created in quadrant Q1 (as represented by release envelope portion 504D of FIG. 5), it does not cause a retention problem and may in fact reduce excess retention.

The example graph 500 shown in FIG. 5 describes a complex release threshold for quadrant Q3 with a 50% attenuation in torque sensed by the leg at release over the full length of the after body of the finite ski 604 (FIG. 6). Beyond that point the complex load on the leg simplifies and approaches a pure couple, a load not associated with the principle mechanism of ACL injury. Therefore, in the example of FIG. 5, the release threshold is programmed to go asymptotic to the 80% grid line as it approaches infinity (a pure couple).

Figure 7:
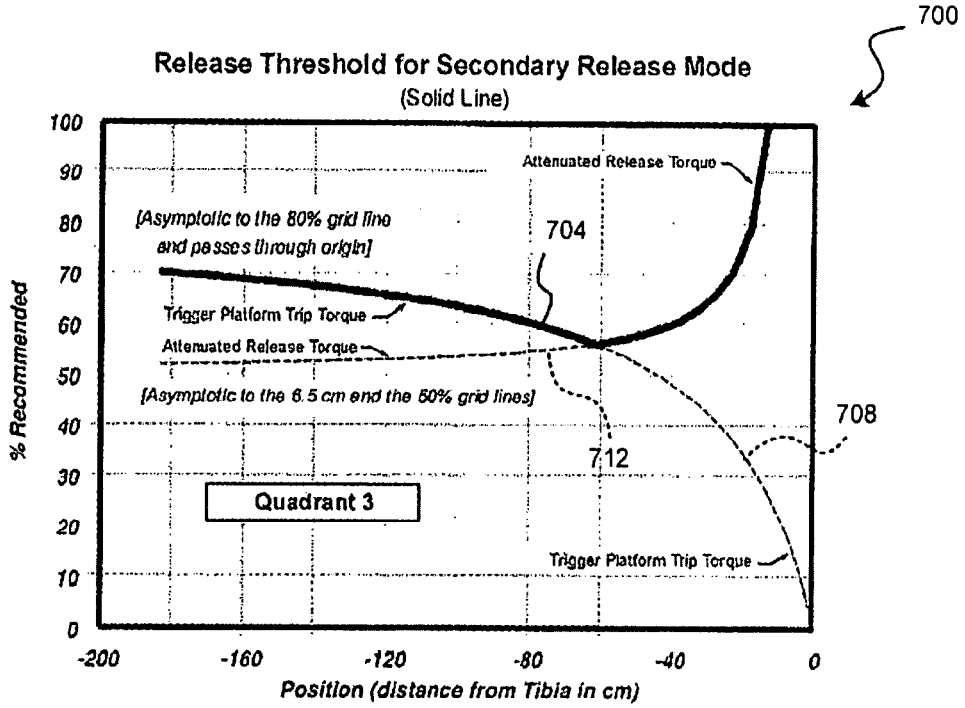
FIG. 7 is a graph of the release threshold for the secondary release mode of the binding system of FIG. 6.

FIG. 7 is a graph 700 illustrating the secondary release threshold 704 (solid line) provided by ski binding system 608 of FIG. 6, i.e., the torque sensed by the skier's leg for loads in quadrant Q3 when the trip torque and attenuated release torque criteria are met. As seen, the secondary release threshold 704 follows a portion of the trip torque profile 708 of trigger platform 620 and a portion of the attenuated release torque profile 712 of secondary toe release 612 (FIG. 6). Graph 700 demonstrates how binding system 608 makes use of portions of both the heel release type binding of FIG. 4 and the toe release type binding of FIG. 2 in its logic for a secondary release in quadrant Q3. FIG. 7 also shows that the release logic of binding system 608 calls for a series, not a parallel solution. This means that the criteria for both actuation of trigger platform 620 and attenuated release of secondary toe release 612 must be met for the attenuated release to take place.

Figure 8:
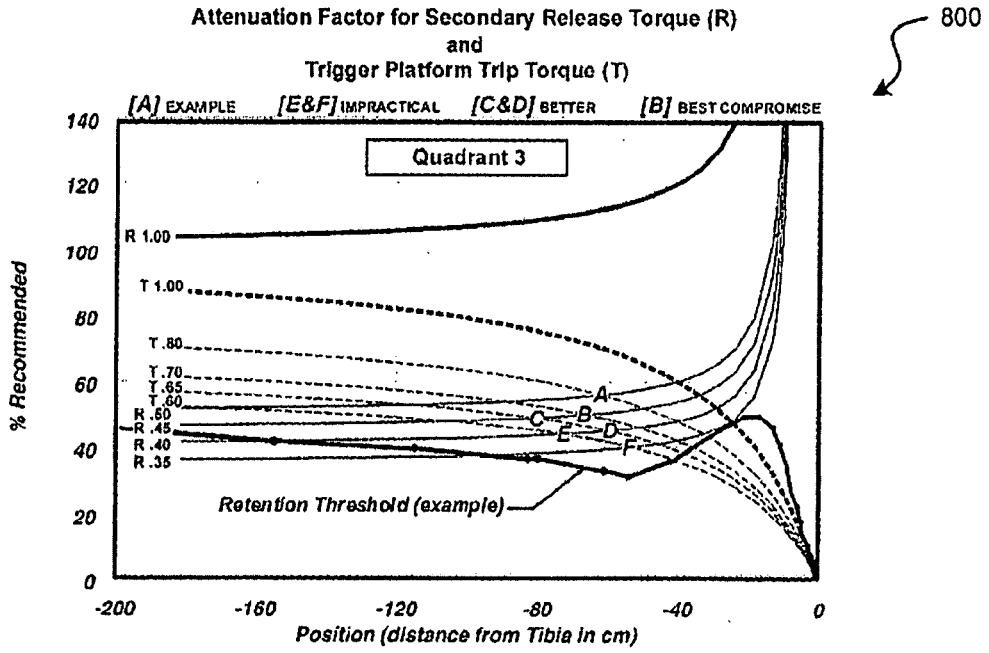
FIG. 8 is a graph of the attenuation factor for the secondary release torque and trigger platform trip torque for the binding system of FIG. 6.

FIG. 8 is a graph 800 that introduces the concept of a retention threshold and various combinations of inputs of the table appearing above. A goal of the process of selecting the attenuated release torque threshold, the trigger platform trip torque, and the locations of the trigger platform and secondary toe release pivot axes 616, 624 is to provide the lowest practical secondary release threshold in areas of quadrant Q3 associated with the greatest risk of ACL injury, while providing an appropriate margin of retention in all other areas of the quadrant. Line A in FIG. 8 refers to the example solution shown in FIGS. 5-7 and in the foregoing table, above. It is noted that line B may be a better compromise. Note that the threshold shown in this figure is for example only. As the requirements for retention in quadrant Q3 are refined, changes will be required to the input values of the foregoing table of inputs and the resulting architecture of an ideal "knee-friendly" binding.

As those skilled in the art will appreciate, the principles outlined above could also be used to modify the release threshold in other quadrants should the need arise.

Figure 9A:
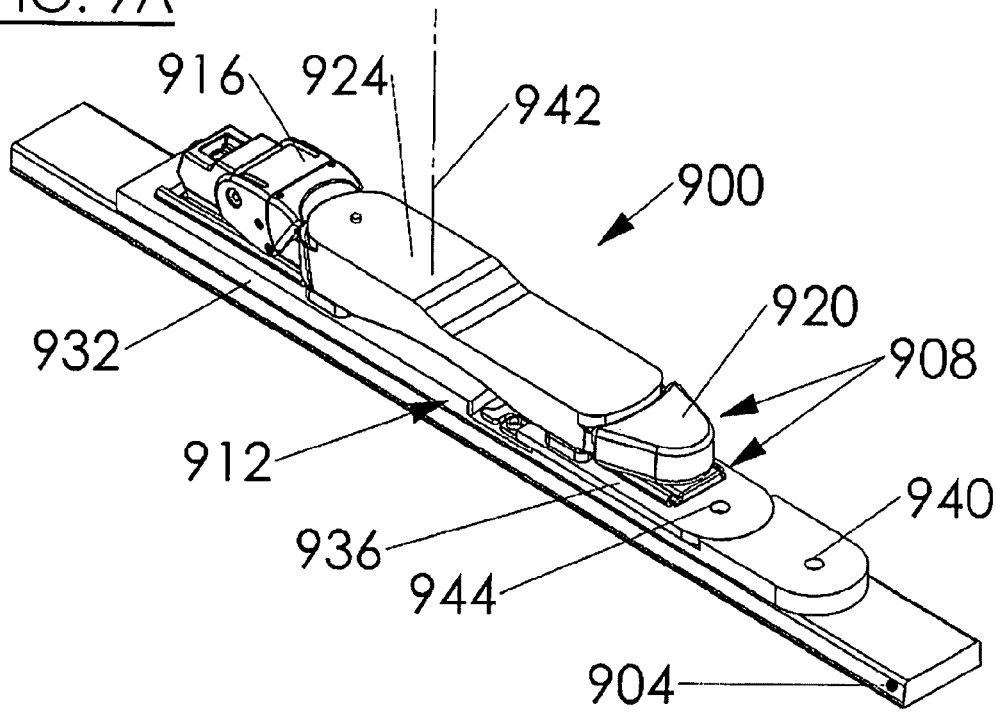
FIG. 9A is an isometric partial top view of a ski system that includes a third-quadrant release-logic mechanism of the present disclosure mounted to a left-leg ski, showing the mechanism in an unreleased state.

Whereas FIGS. 5-8 address general concepts of the present invention, the following FIGS. 9A-24 illustrate examples of binding system configurations that can be used to achieve the release logic that provides an attenuated release in response to substantially only loads applied in the third quadrant. Referring now to FIGS. 9A-11, FIG. 9A illustrates an alpine ski system 900 made in accordance with the present invention. Ski system 900 includes a left ski 904 and a binding system 908 that includes a third-quadrant release-logic mechanism 912 and heel and toe pieces 916, 920, respectively. In this example, heel and toe pieces 916, 920 are contemporary conventional heel and toe pieces available from manufacturers such as Tyrolia, Marker, Salomon, Atomic, Rossignol, etc. The selection of conventional heel and toe pieces for this example serves to clearly illustrate the general concept of the third-quadrant release logic (here provided by third-quadrant release-logic mechanism 912) and its relation to current conventional bindings that consist essentially only of heel and toe pieces 916, 920. This selection also serves to illustrate that third-quadrant release-logic mechanism 912 could readily be sold as a retrofit component for conventional ski systems or otherwise separately from conventional skis and binding. FIG. 9A also illustrates, for the sake of context, a ski-boot sole 924 clamped into binding system 908 in a conventional manner between heel and toe pieces 916, 920. Third-quadrant release-logic mechanism 912 is essentially configured to change the release-threshold envelope 204A-B (FIG. 2) for shear forces applied to ski 904 in the third quadrant.

Figure 9B:
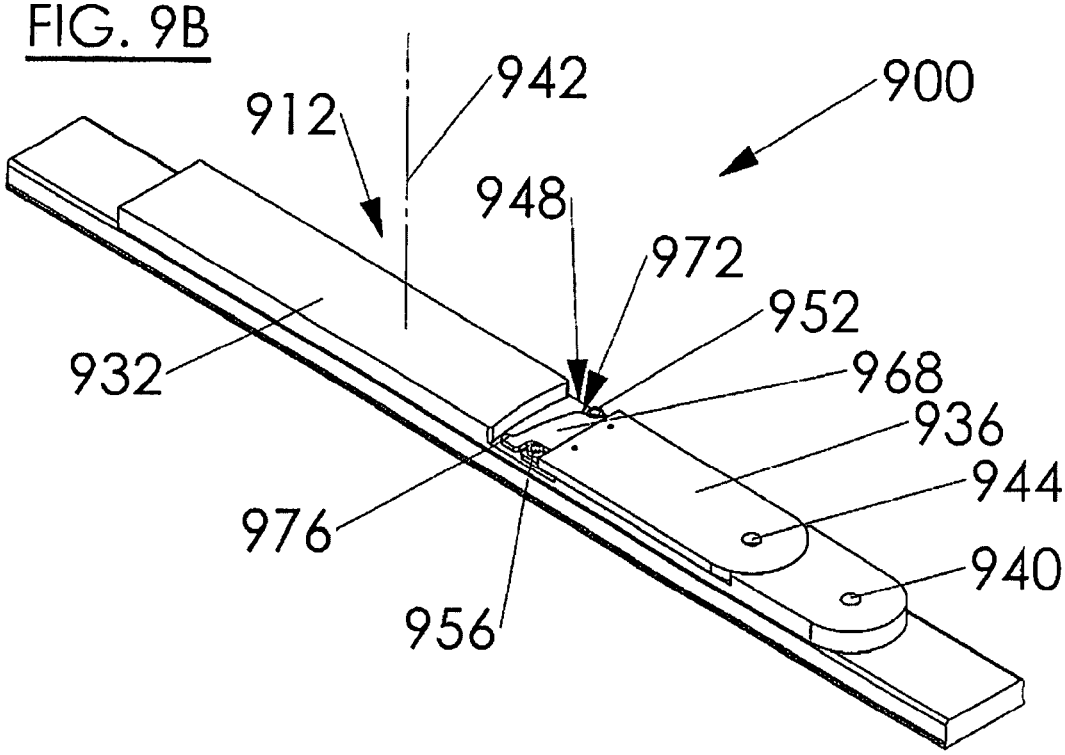
FIG. 9B is an isometric partial top view (rotated 180° relative to FIG. 9A) of the third-quadrant release-logic mechanism of FIG. 9A with the boot sole and the heel and toe pieces removed for clarity.

Referring now to FIG. 9B, which is similar to FIG. 9A but shows ski system 900 without ski-boot sole 924 and heel and toe pieces 916, 920 for the sake of illustration, FIG. 9B shows two primary components of release-logic mechanism 912, i.e., a trigger platform 932 and a secondary toe release 936. Heel piece 916 (FIG. 9A) is fixedly secured to trigger platform 932, and toe piece 920 is fixedly secured to secondary toe release 936. As will be described below in detail, trigger platform 932 is pivotably secured to ski 904 at a pivot point 940 located forward (toward the tip of the ski) of the toe end of ski-boot sole 924 (FIG. 9A) and, since ski 904 is a left-leg ski, is secured to the ski so as to be pivotable relative to the ski only in a counterclockwise direction from the position shown in FIG. 9B. For a right-foot ski (not shown), a comparable trigger platform would be secured to the right-foot ski so as to be pivotable only in a clockwise direction. In addition to being pivotable only in the counterclockwise direction, trigger platform 932 is constrainably pivotable in the counterclockwise direction such that a non-zero threshold shear force, which translates into a "trigger trip torque", is needed in the third quadrant before the trigger platform begins to move appreciably and provide its triggering effect. One example of a trigger trip torque mechanism for providing this trigger threshold is an adjustable trip torque mechanism 1100, described below in connection with FIG. 11. As discussed below, this trip torque is a function of the location of pivot point 940 relative to tibial axis 942, as well as the setting of the trip torque mechanism. For the present discussion, however, it is necessary only to understand that trigger platform 932 is constrainably pivotable only in the counterclockwise direction. Otherwise, trigger platform 932 is secured to ski 904 so that substantially no movement occurs between these two components in a direction normal to the width of the ski.

Secondary toe release 936 is secured to trigger platform 932 so as to be constrainably pivotable about a pivot point 944 located between the toe end of ski-boot sole 924 (FIG. 9A) and pivot point 940 of the trigger platform and to be pivotable substantially only in a clockwise direction relative to the trigger platform from the position shown in FIG. 9B. Third-quadrant release-logic mechanism 912 also includes an attenuated release threshold mechanism, such as adjustable release threshold mechanism 1104 of FIG. 11, that provides secondary toe release 936 with a constrained pivoting action. The resistance torque of secondary toe release 936 caused by the secondary-release threshold mechanism is referred to herein as "attenuated release torque." When trigger platform 932 is in a non-triggering position, such as shown in FIG. 9B, secondary toe release 936 is held in the unreleased position shown in FIG. 9B by a triggerable latch mechanism, such as latch mechanism 948. Latch mechanism 948 includes a latch 952 pivotably secured to trigger platform 932 at a pivot point 956. Latch 952 includes an opening 960 (FIG. 10B) that receives a pin 964 (FIG. 10B), which is fixed relative to ski 904. In the unreleased position of secondary toe release 936 shown, latch 952 engages a catch 968 that is fixed to the secondary toe release.

Figure 10A:
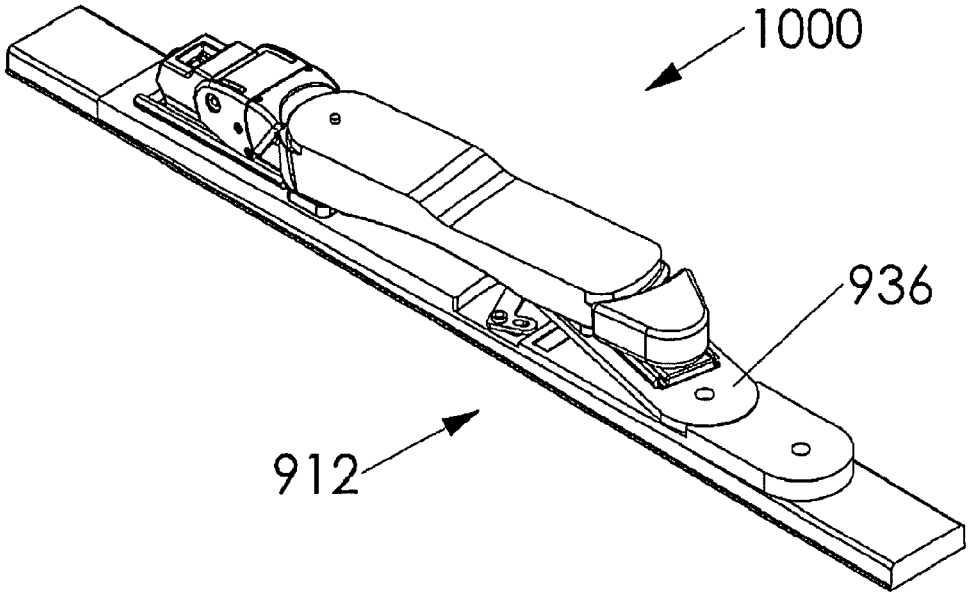
FIG. 10A is an isometric partial top view of the ski system of FIG. 9A showing the third-quadrant release-logic mechanism in a released state.
Figure 10B:
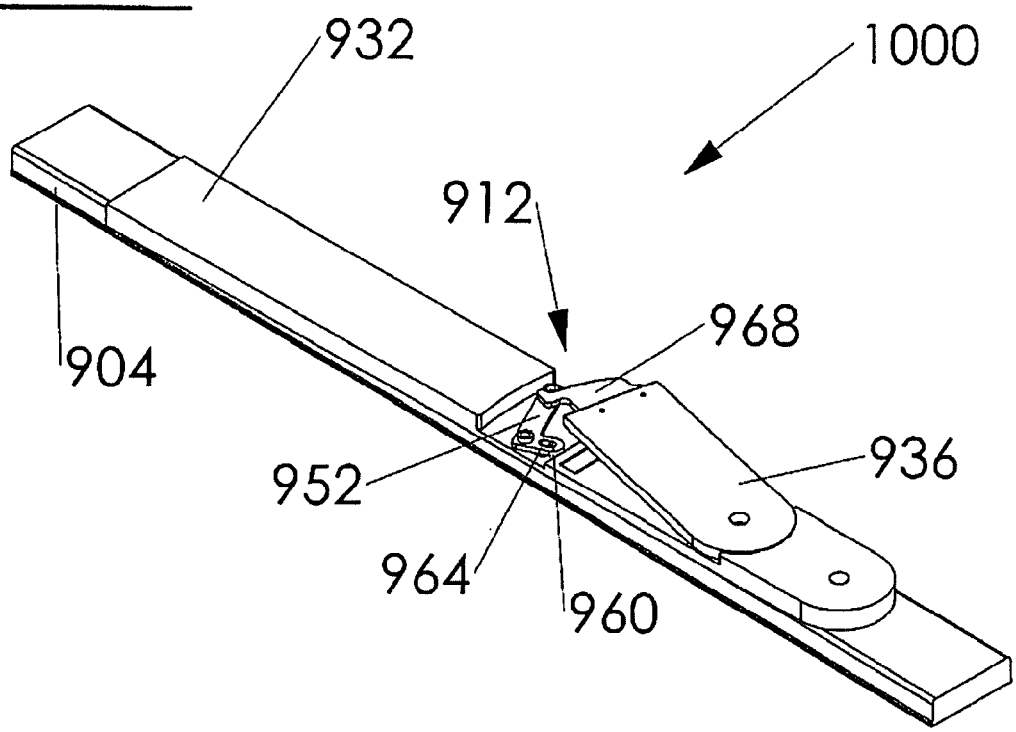
FIG. 10B is an isometric partial top view (rotated 180° relative to FIG. 10A) of the third-quadrant release-logic mechanism of FIG. 10A with the boot sole and the heel and toe pieces removed for clarity.

When trigger platform 932 pivots counterclockwise relative to ski 904 in response, for example, to a threshold-exceeding torque in response to a shear force in the third quadrant (see FIG. 1), latch 952 and its pivot point 956 (which is fixed relative to the trigger platform) move, thereby causing stationary pin 964 (FIG. 10B) to pivot the latch about its pivot point and cause the distal end 972 of the latch to move out of engagement with catch 968 on secondary toe release 936. With distal end 972 of latch 952 out of the way, secondary toe release 936 is free to pivot in response to a torque exceeding the secondary release torque clockwise relative to trigger platform 932, thereby releasing ski-boot sole 924 (FIG. 9A) from binding system 908 (FIG. 9A). If desired, secondary toe release 936 may be provided with a secondary catch 976 for engaging distal end 972 of latch 952 when third-quadrant release-logic mechanism 912 is in a released state so as to limit the pivoting of the secondary toe release. FIGS. 10A-B each show third-quadrant release-logic mechanism 912 in a released state 1000, with trigger platform 932 pivoted counterclockwise relative to ski 904, latch 952 pivoted counterclockwise out of engagement with catch 968 and secondary toe release 936 pivoted clockwise relative to the trigger platform. Again, this released state 1000 is substantially only achieved from the unreleased state upon application of a shear force to the third-quadrant of ski 904 that exceeds both the trip plate trigger torque and the secondary toe release torque.

Figure 11:
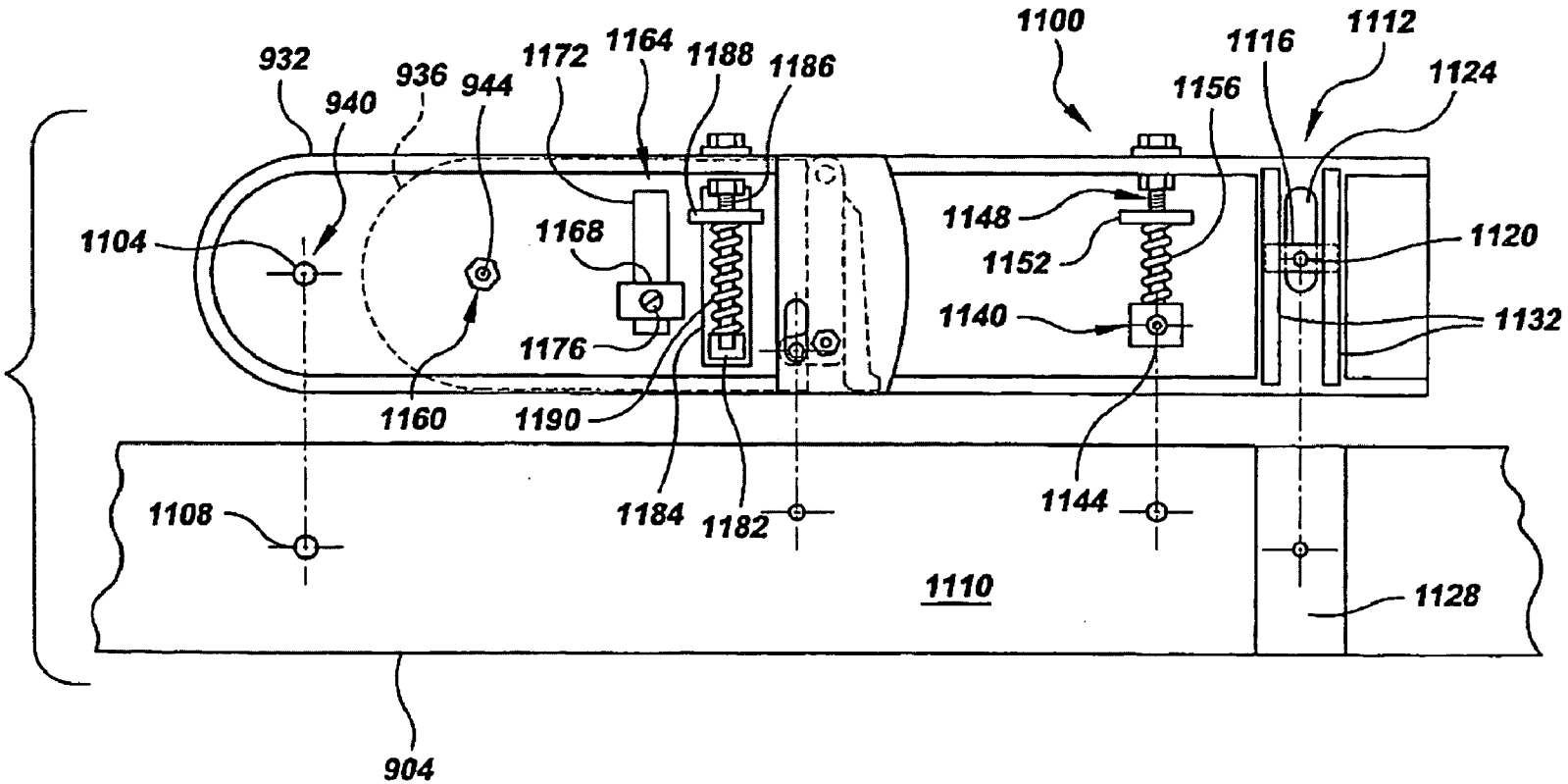
FIG. 11 is an enlarged plan view of the ski system of FIGS. 9A-10B showing the upper surface of the ski and the trigger platform (and the secondary toe release) removed and placed upside-down next to the ski so as to illustrate exemplary components that may be used to make the third-quadrant release-logic mechanism work.

Referring now to FIG. 11, it was mentioned above that trigger platform Q332 is secured to ski 904 so as to be constrainably pivotable about pivot point 940. FIG. 11 illustrates examples of mechanisms that can be used to provide this type of securement. In this example, trigger platform 932 is fastened to ski 904 by a threaded fastener 1104 that threadedly engages a matching threaded opening 1108 in the ski. The engagement of fastener 1104 with trigger platform 932 and ski 904 is such that when the trigger platform is properly secured to the ski it is substantially freely pivotable about pivot point 940 but constrained from moving away from the upper surface 1110 of the ski. In other embodiments, a fastener other than a threaded fastener may be used. In addition, if desired, a torsion mechanism (not shown) or other pivot-constraining connection may be provided to provide a desired amount of resistance to pivoting.

Trigger platform 932 is also held down by a sliding hold-down mechanism 1112 that, when the trigger platform is properly installed on ski 904, allows the trigger platform to pivot about pivot point 940 but not substantially move away from upper surface 1110 of the ski. In this example, hold-down mechanism 1112 includes a slidable hold-down 1116 that is fixedly secured to ski 904, for example, using a threaded fastener 1120. Hold-down 1116 is movable within a generally T-shaped slot 1124 on trigger platform 932 that is preferably, but not necessarily, sized to limit the range of pivot of the trigger platform. The T-shape of slot 1124 generally conformally receives the combination of hold-down 1116 and fastener 1120 that largely forms a like T-shape. To reduce friction, ski 904 may be provided with a low-friction bearing plate 1128 and/or trigger platform 932 may be provided with one or more low-friction bearings 1132.

As mentioned, the resistance to pivoting of trigger platform 932 relative to ski 904 that provides the trigger platform with a trigger trip torque threshold is provided by adjustable trip torque mechanism 1100. In this example, trip torque mechanism 1100 includes a fixed screw-guide bracket 1140 that is fixedly secured to ski 904, for example, using a threaded fastener 1144. Screw-guide bracket 1140 receives an adjustment screw 1148 in a manner that secures the adjustment screw to the bracket, but allows it to rotate freely in a non-threaded way. A rectangular threaded adjustment nut 1152 is threadedly engaged with adjustment screw 1148 so that when the trigger platform is properly secured to ski 904 and the adjustment screw is turned, the adjustment nut moves longitudinally along the screw (the rotation of the adjustment nut is inhibited by its engagement with the underside of the trigger platform). A spring, here a coil spring 1156, is provided between fixed screw-guide bracket 1140 and threaded adjustment nut 1152 such that the spring can be selectively compressed/decompressed by turning adjustment screw 1148 so that the adjustment nut moves closer to or farther away from the screw-guide bracket. With this trip torque mechanism 1100, when trigger platform 932 is properly secured to ski 904, it can be seen that the trip torque threshold of the trigger platform can be increased by turning adjustment screw 1148 so that adjustment nut 1152 further compresses spring 1156, and, conversely, the trigger threshold of the trigger platform can be decreased by turning the adjustment screw so that the adjustment nut moves away from screw-guide bracket 1140 and decompresses the spring. In other embodiments, other trigger trip torque adjusting mechanisms may be provided by those having ordinary skill in the art without undue experimentation using the present disclosure as a guide.

As mentioned above, secondary toe release 936 is secured to trigger platform 932 so that it is pivotable about pivot point 944 in a constrained manner. In this example, secondary toe release 936 is secured to trigger platform 932 using a locking nut/bolt combination 1160 at pivot point 944 and a sliding hold-down mechanism 1164 spaced from pivot point 940. Sliding hold down mechanism 1164 includes a slidable hold-down 1168 that is fixedly secured to secondary toe release 936 through a slot 1172 in trigger platform 932 using a suitable fastener 1176. Hold-down 1168 is wider than slot 1172, and fastener 1176 is tightened to the point that movement of the secondary toe release away from the trigger platform is substantially constrained, but not to the point that the secondary toe release cannot pivot substantially freely.

Similar to trigger platform 932 relative to ski 904, secondary toe release 936 is provided with adjustable attenuated release threshold mechanism 1104 that allows a user to set a desired resistance to pivoting of the secondary toe release relative to the trigger platform. In this example, adjustable attenuated release threshold mechanism 1104 includes a screw-guide bracket 1182 fixed to secondary toe release 936 through a slot 1184 in trigger platform 932. Screw-guide bracket 1182 receives an adjustment screw 1186 in a manner that secures the adjustment screw to the bracket, but allows it to rotate freely in a non-threaded way. A rectangular threaded adjustment nut 1188 is threadedly engaged with adjustment screw 1186 so that the adjustment nut moves longitudinally along the screw (the rotation of the adjustment nut is inhibited by its engagement with the underside of the trigger platform). A spring, here a coil spring 1190, is provided between fixed screw-guide bracket 1182 and threaded adjustment nut 1188 such that the spring can be selectively compressed/decompressed by turning adjustment screw 1186 so that the adjustment nut moves closer to or farther away from the screw-guide bracket. With this adjustable attenuated release threshold mechanism 1104, it can be seen that the pivot-resistance of secondary toe release 936 can be increased by turning adjustment screw 1186 so that adjustment nut 1188 further compresses spring 1190, and, conversely, the pivot-resistance of the secondary toe release can be decreased by turning the adjustment screw so that the adjustment nut moves away from screw-guide bracket 1182 and decompresses the spring. In other embodiments, other attenuated release threshold-adjusting mechanisms may be provided by those having ordinary skill in the art without undue experimentation using the present disclosure as a guide.

Those skilled in the art will readily appreciate that the embodiment of FIGS. 9A-11 is merely one example of release logic that provides an attenuated release envelope for shear forces applied in the third quadrant. Following are descriptions of three additional examples to illustrate this point. As will be seen in reviewing these additional examples, there are a number of ways to implement the differing aspects of the release logic, such as the implementation of the trigger and the setting of the trigger trip torque, and the implementation of the secondary toe release and the setting of attenuated-release threshold, among other things.

Figure 12:
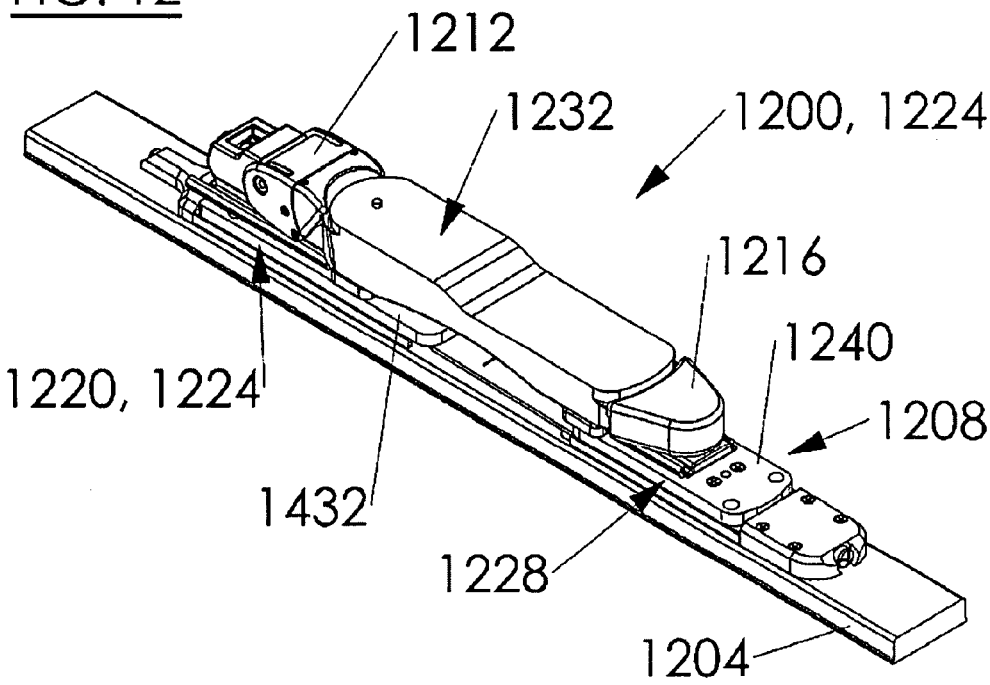
FIG. 12 is an isometric partial top view of a second embodiment of a ski system that includes a third-quadrant release-logic mechanism of the present disclosure mounted to a right-leg ski, showing the mechanism in an unreleased state.
Figure 13:
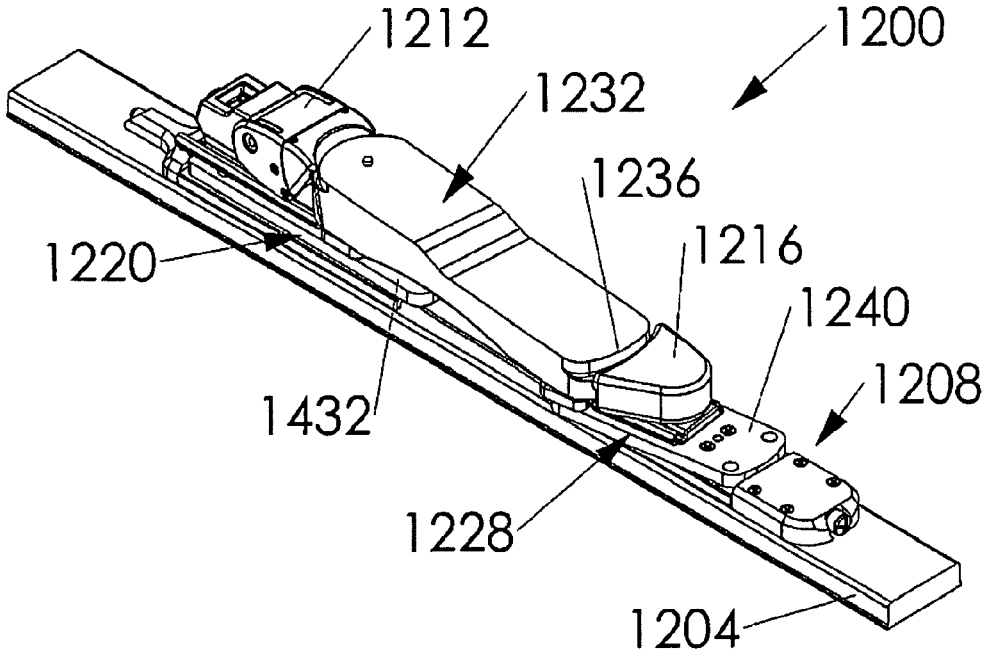
FIG. 13 is an isometric partial top view of a second embodiment of the ski system of FIG. 12 showing the third-quadrant release-logic mechanism in a released state.
Figure 14:
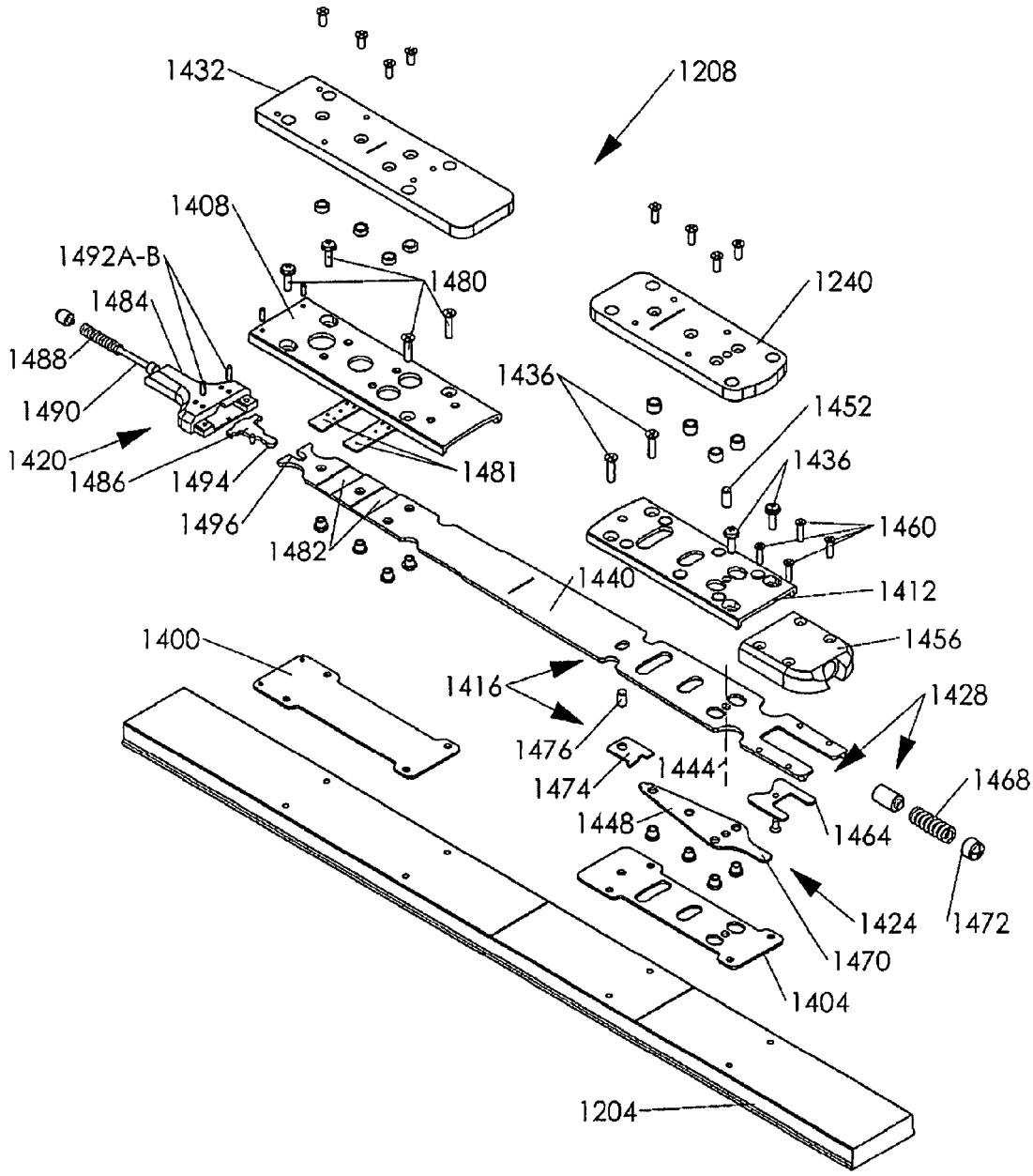
FIG. 14 is an isometric exploded partial view of a second embodiment of the ski system of FIGS. 12 and 13 showing the various components of the system.
Figure 15:
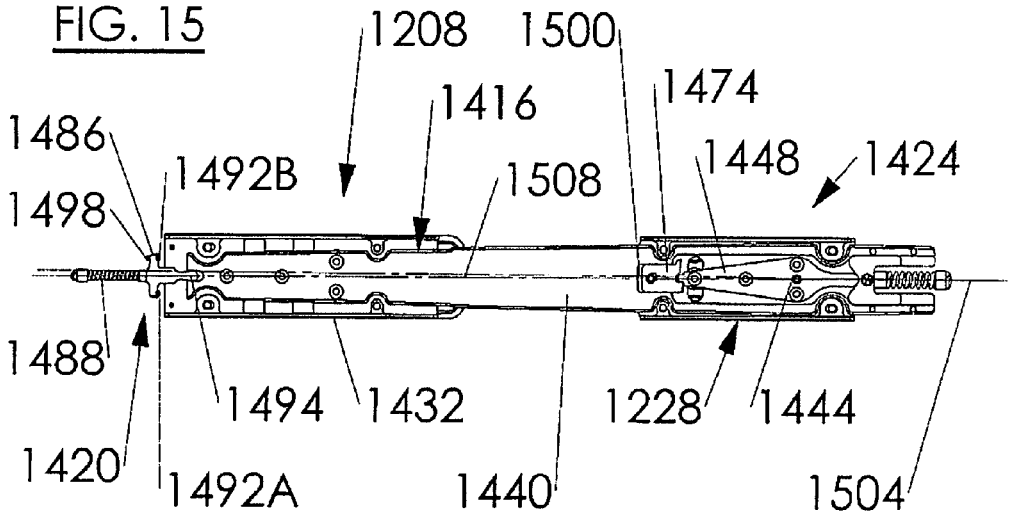
FIG. 15 is a bottom view of a second embodiment of the third-quadrant release-logic mechanism of FIG. 12 with bottom plates removed to illustrate the state of components of the mechanism when the mechanism is in its unreleased state.
Figure 16:
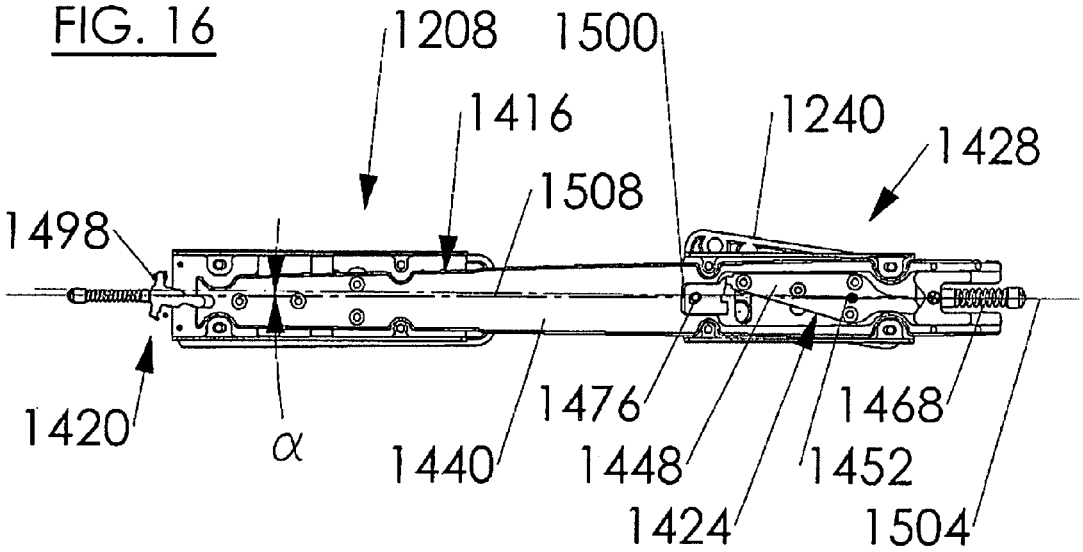
FIG. 16 is a bottom view of a second embodiment of the third-quadrant release-logic mechanism of FIG. 13 with bottom plates removed to illustrate the state of components of the mechanism when the mechanism is in its released state.

Turning now to the first of the additional examples, FIGS. 12 and 13 each show an alpine ski system 1200 generally similar to ski system 900 of FIGS. 9A-11 in that it includes a ski 1204, a third-quadrant release-logic mechanism 1208 mounted to the ski and heel and toe pieces 1212, 1216 mounted to the third-quadrant release-logic mechanism. Similar to ski system 900 of FIGS. 9A-11, heel and toe pieces 1212, 1216 of FIGS. 12 and 13 may be any suitable alpine heel and toe pieces, if desired. FIG. 12 shows third-quadrant release-logic mechanism 1208 in an unreleased state, and FIG. 13 shows the third-quadrant release-logic mechanism in a released state. As described below, third-quadrant release-logic mechanism 1208 includes a trigger 1220 that is generally similar to the trigger mechanism of ski system 900, above. Heel piece 1212 is secured to an elongate trigger assembly 1224 near the trailing end of the assembly, and similarly to ski system 900 of FIGS. 9A-11, toe piece 1216 is secured to a pivoting secondary toe release 1228. A conventional standard boot sole 1232 is shown for context. As readily seen in FIG. 13, ski system 1200 is set up for the right leg of a skier since the pivoting of the toe 1236 of boot sole 1232 is clockwise in response to a shear force being applied to ski 1204 in the third quadrant. FIGS. 14-16 show details of the various components of third-quadrant release-logic mechanism 1208 that provide the attenuated release of toe 1236 of boot sole 1232 in response to only loads in the third quadrant.

Referring now to FIG. 14, this figure illustrates the various components of third-quadrant release-logic mechanism 1208. Major components of third-quadrant release-logic mechanism 1208 include: rearward and forward lower mounting plates 1400, 1404; rearward and forward upper mounting plates 1408, 1412; a trigger mechanism 1416; a trigger trip torque mechanism 1420; a secondary toe release mechanism 1424, an attenuated release threshold mechanism 1428 and a heel piece mounting plate 1432. As seen in FIGS. 12 and 13, heel piece 1212 is fixedly secured to heel piece mounting plate 1432 and toe piece 1216 is fixedly secured to a toe piece mounting plate 1240 of secondary toe release mechanism 1424. Referring again to FIG. 14, forward upper and lower mounting plates 1412, 1404 are fixedly secured to ski 1204 using suitable fasteners 1436. Trigger 1220 includes a pivotable, flexible (in a direction normal to the upper surface of ski) trigger member 1440, which is captured between forward upper and lower mounting plates 1412, 1404 so as to be slightly pivotable about a pivot axis 1444 normal to upper surface of ski 1204.

Secondary toe release mechanism 1424 includes in addition to toe piece mounting plate 1240 a pivotable latch 1448 that is captured between trigger member 1440 and forward lower mounting plate 1404. Toe piece mounting plate 1240 is fixedly secured to latch 1448 and, for the purpose discussed below, the composite of these components is pivotably secured to trigger member 1440 about a pivot pin 1452 so that the toe piece mounting plate and latch (and toe piece 1216 (FIG. 12)) pivot in unison under a release condition. The attenuated release threshold for pivoting action of these components is provided by attenuated release threshold mechanism 1428, which includes a housing 1456 fixedly secured to trigger member 1440 with screws 1460 and a movable cam 1464 and spring 1468 located in the housing. Cam 1464 engages a cam follower 1470 on pivotable latch 1448. The attenuated release threshold is set using an adjustment screw 1472, which adjusts the length of spring 1468, and therefore the force applied by cam 1464 to cam follower 1470. In the unreleased state of third-quadrant release-logic mechanism 1208, latch 1448 is securely engaged with a catch 1474, which as described below, is seated in a groove 1500 (FIG. 15) in trigger member 1440 that inhibits its lateral movement relative to the trigger member, but, as described below in detail, allows it to move longitudinally relative to the trigger member as a result of its interaction with a pin 1476 that is fixed relative to forward upper and lower mounting plates 1412, 1404. When latch 1448 is securely engaged with catch 1474, the attenuated release of secondary toe release 1228 is not active and toe piece 1216 (FIG. 12) functions as it would in a conventional ski system.

Rearward upper and lower mounting plates 1408, 1400 are secured to ski 1204 using suitable fasteners 1480 and capture the rear end of trigger member 1440 therebetween. Heel piece mounting plate 1432 is fixedly secured to trigger member 1440 so that they pivot in unison with one another about pivot point 1444 of the trigger member when permitted by trigger trip torque mechanism 1420. In general, it is the lateral loads from heel piece 1212 (FIG. 12) that are the input to trigger mechanism 1420. A pair of low friction members 1481 that engage a corresponding respective pair of grooves 1482 in trigger member 1440 are provided to reduce the amount of frictional resistance between rearward upper mounting plate 1408 and the trigger member during pivoting of the trigger member.

Trigger trip torque mechanism 1420 is fixedly secured to ski 1204 via rearward upper and lower mounting plates 1408, 1400 and includes a housing 1484, a T-shaped resistance toggle 1486, a spring 1488 and an adjustment screw 1490. Spring 1488 biases toggle 1486 into engagement with a pair of fulcrum pins 1492A-B that are fixed relative to housing 1484. Toggle 1486 includes a lever arm 1494 that engages a notch 1496 in trigger member 1440. As will be described below in more detail, as trigger member 1440 pivots it applies a force to lever arm 1494 of toggle 1486 that works against the biasing force applied to the trigger by spring 1488 as the toggle pivots about the appropriate one of fulcrum pins 1492A-B. A locking pin 1498 (FIG. 15) is provided so as to capture toggle 1486 between it and one of fulcrum pins 1492A-B so as to inhibit the toggle from pivoting about the other fulcrum pin. By switching the location of locking pin 1498 (FIG. 15), trigger mechanism 1416 can be set up for either a left-leg ski or a right-leg ski (the right-leg setup being shown). When changing the location of locking pin 1498 (FIG. 15), catch 1474 must also be flipped to change the pivot direction of secondary toe release 1228. This should become apparent from the following description of the working of third-quadrant release-logic mechanism 1208 relative to FIGS. 15 and 16.

Referring now to FIGS. 15 and 16, which are "upside down" views of third-quadrant release-logic mechanism 1208 relative to FIGS. 12-14, FIG. 15 shows the third-quadrant release-logic mechanism in its unreleased state, and FIG. 16 shows the mechanism in an attenuated release state caused by a triggering shear force in the third quadrant of ski 1204 (FIGS. 12-14). In FIG. 15, the longitudinal centerline 1504 of trigger member 1440 is aligned with the longitudinal centerline 1508 of the ski, latch 1448 of secondary toe release mechanism 1424 is securely engaged with catch 1474. Consequently, secondary toe release 1228 is securely held by catch 1474 from pivotably releasing. In this state, heel and toe pieces 1212, 1216 (FIGS. 12 and 13) act in the same manner they would if affixed to a ski in a conventional manner. Note the location of locking pin 1498 of trigger trip torque mechanism 1420. In this example, it is located so that trigger member 1440 can pivot only in a counterclockwise direction about pivot axis 1444. Therefore, any shear loads applied in the second and fourth quadrants will not allow trigger mechanism 1416 to trigger. However, when a shear load is applied to ski 1204 (FIGS. 12 and 13) in the third quadrant, and is counteracted in part by a force applied through heel piece mounting plate 1432, this shear force causes trigger member 1440 to apply a toggling force to lever arm 1494 of toggle 1486. Once this toggling force overcomes the resistance and preload of the spring 1488, trigger member 1440 will pivot about pivot axis 1444, as illustrated in FIG. 16, albeit by a relatively small angle $\alpha$ relative to the ski's longitudinal axis 1504.

Since catch 1474 is laterally captured in groove 1500 in trigger member 1440, this pivoting of the trigger member causes the catch to move and interact with fixed pin 1476 that is fixed relative to ski 1204 (FIGS. 12-14) via forward upper and lower mounting plates 1412, 1404 (FIG. 14). This interaction with fixed pin 1476 moves catch 1474 just enough for latch 1448 to disengage the catch. With latch 1448 disengaged from catch 1474, it can pivot about pivot pin 1452 once the force applied to toe piece mounting plate 1240 from toe 1236 of boot sole 1232 (FIGS. 12 and 13) is large enough to overcome the attenuated release threshold bias of spring 1468 of attenuated release threshold mechanism 1428. After the attenuated secondary release has occurred, trigger mechanism 1416 and secondary toe release mechanism 1424 automatically return to their unreleased states. It is noted that the shape of catch 1474 is such that latch 1448 can pivot only clockwise when secondary toe release mechanism 1424 has been triggered and is in a released state. As mentioned above, a right-leg ski setup can be switched to a left-leg setup by flipping catch 1474 generally about longitudinal axis 1508 of trigger member 1440 and by switching the location of locking pin 1498 of trigger trip torque mechanism 1420.

Figure 17:
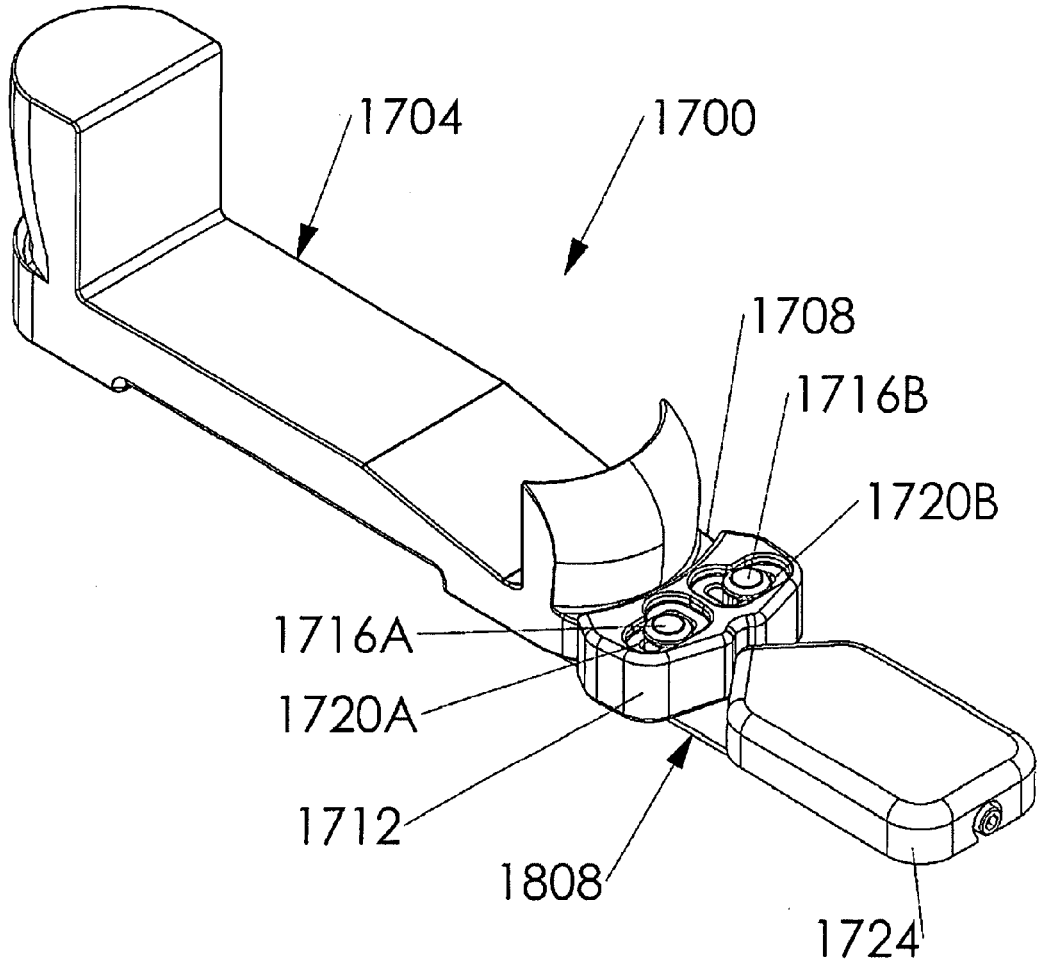
FIG. 17 is an isometric top view of a boot sole and a dual-release-threshold toe assembly that can be substituted for the secondary to release mechanisms of FIGS. 3A-5 and FIGS. 12-16, respectively.
Figure 18:
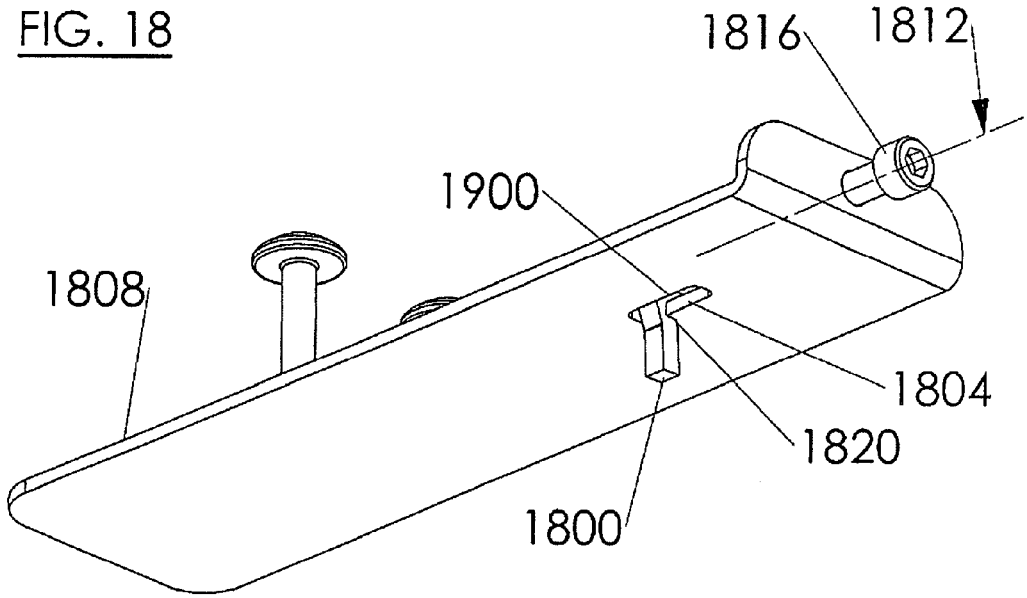
FIG. 18 is an isometric bottom view of the base of the toe assembly of FIG. 17 showing the actuator in its unreleased position.
Figure 19:
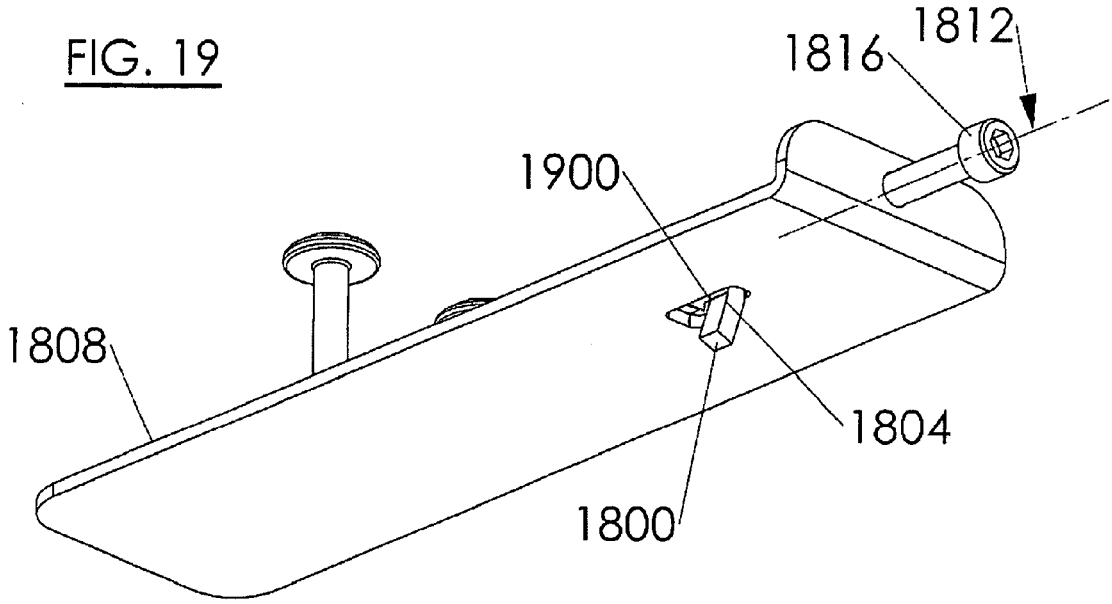
FIG. 19 is an isometric bottom view of the base of the toe assembly of FIG. 17 showing the actuator in a released position.

While third-quadrant release-logic mechanisms 912, 1208 of FIGS. 9A-11 and FIGS. 12-16, respectively, are similar in the context of the ability to utilize conventional heel and toe pieces, the second of the additional examples illustrated in FIGS. 17-21 utilizes a unique toe assembly 1700 (FIG. 17) that provides the secondary toe release and the adjustable attenuated release threshold without the need for the pivotable secondary release plate. In addition to toe assembly 1700, FIG. 17 shows a conventional standard boot sole 1704 having its toe 1708 engaged with the toe assembly. Referring to FIGS. 12 and 14, toe assembly 1200 of FIG. 17 replaces both of secondary toe release mechanism 1424 and attenuated release threshold mechanism 1428, but can be used, if desired, with a trigger mechanism and trigger trip torque mechanism substantially similar to, respectively, trigger mechanism 1416 and trigger trip torque mechanism 1420 of FIGS. 12 and 14. Modifications to third-quadrant release-logic mechanism 1208 of FIGS. 12 and 14 to accommodate toe assembly 1700 of FIG. 17 would include removing the pivotable toe piece mounting plate 1240 and latch 1448, removing attenuated release threshold mechanism 1428 and removing catch 1474. Then, toe assembly 1700 of FIG. 17 would be fixedly secured to forward upper mounting plate 1412. As seen in FIGS. 18 and 19, toe assembly 1700 of FIG. 17 includes a movable actuator 1800 that is guidably movable within an L-shaped slot 1804 formed in a base 1808 of the toe assembly. Actuator 1800 is movable both pivotably about the longitudinal centerline 1812 of an adjustment screw 1816 and translationally in a direction parallel with longitudinal centerline 1812. It is this movable actuator 1800 that trigger member 1440 (FIG. 14) would pivot above longitudinal centerline 1812. For reasons that might not be apparent until after reading the following description, trigger member 1440 would need to be slotted substantially along its longitudinal axis (1504, FIG. 15) to allow the actuator to translate along longitudinal centerline 1812 of adjustment screw 1816. Otherwise, the trigger member and trigger trip torque mechanism for toe assembly 1700 may be the same as shown in FIG. 14. Those skilled in the art will readily appreciate that third-quadrant release-logic mechanism 912 of FIGS. 9A-11 may also be modified in a similar manner. In addition, it is noted that the trigger for toe assembly 1700 of FIG. 17 may be of some other type, such as an electronic trigger that is responsive to input from, e.g., one or more force, displacement and/or acceleration transducers.

Figure 20:
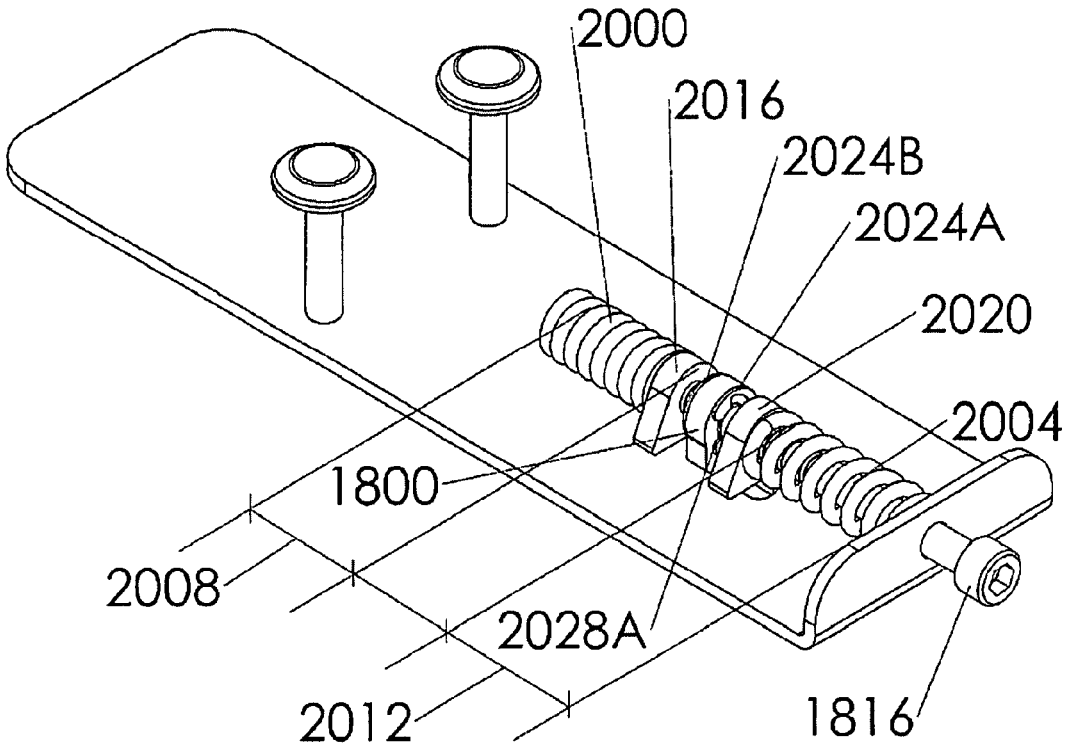
FIG. 20 is an isometric top view of the toe assembly showing the housing, toe retainer and toe retainer studs removed, illustrating the unreleased state of the toe assembly.
Figure 21:
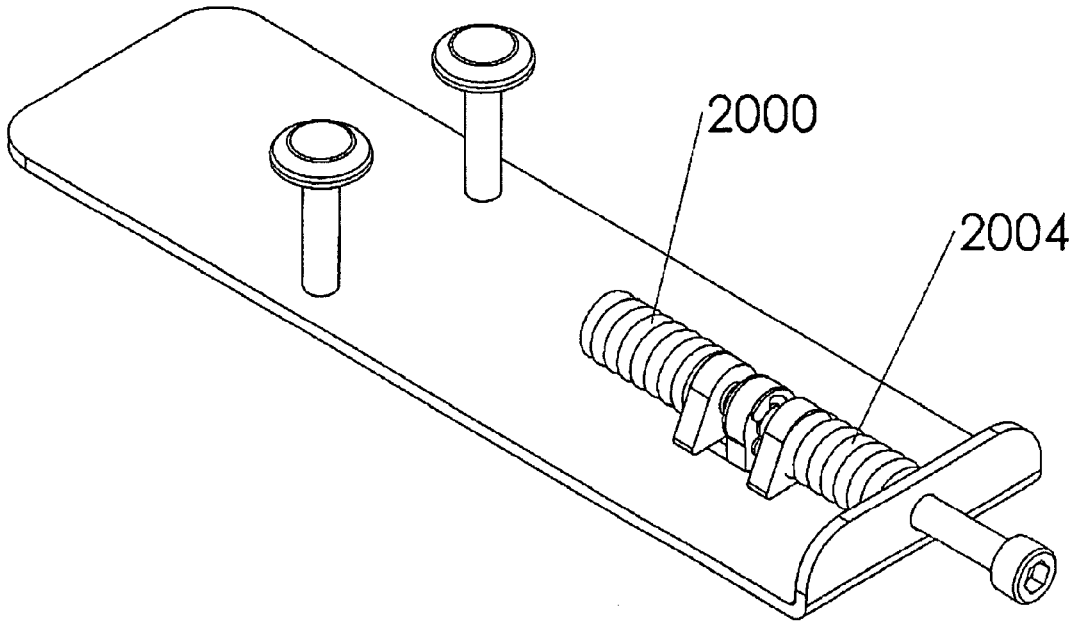
FIG. 21 is an isometric top view of the toe assembly showing the housing, toe retainer and toe retainer studs removed, illustrating the unreleased state of the toe assembly.

Referring to FIGS. 17, 20 and 21, in addition to base 1808, actuator 1800 and adjustment screw 1816, toe assembly 1700 includes a toe retainer 1712 movably secured to the base, for example, by a pair of studs 1716A-B. Toe retainer 1712 includes a pair of L-shaped slots 1720A-B that, under the right loading conditions, allows the toe retainer to pivot either clockwise or counterclockwise so as to release toe 1708 of boot sole 1704. Toe retainer 1712 is biased into engagement with studs 1716A-B by a force-applying member, such as housing 1724, that is movable relative to base 1808 and that, in turn is biased by either one or both of springs 2000, 2004 (FIGS. 20 and 21) located within the housing, depending on whether or not toe assembly 1700 is in its unreleased or released state.

Referring to FIGS. 20 and 21, adjustment screw 1816 has a left-hand thread region 2008 and a right-hand thread region 2012, with actuator 1800 located between these two regions. Each of the left- and right-hand thread regions 2008, 2012 is threadedly engaged by a corresponding movable stop 2016, 2020 that moves in an opposite direction from the other when adjustment screw 1816 is turned. In this manner, either both springs 2000, 2004 are being compressed or both springs are being decompressed, depending on which direction adjustment screw 1816 is turned. Actuator 1800 is not threadedly engaged with adjustment screw 1816. Rather, adjustment screw 1816 is free to rotate within an unthreaded opening in actuator 1800. However, actuator 1800 is substantially fixed from moving along longitudinal centerline 1812 of adjustment screw 1816 using, in this example, a C-clip 2024A-B on either side of the actuator that engages a corresponding groove 2028A-B (only groove 2028A can be seen) in the adjustment screw.

Consequently, and referring to FIGS. 17-21, toe assembly 1700 operates as follows to provide a "normal" release (i.e., a release akin to the release of a conventional binding secured to a ski in a conventional manner) and an attenuated release in response to a suitable shear loading in the third quadrant. With actuator 1800 in its unreleased position, i.e., locked in the transverse portion 1820 of slot 1804 as shown in FIGS. 18 and 20, only spring 2000 is active in biasing housing 1724 against toe retainer 1812. Therefore, the force applied to toe retainer 1812 is equal to the spring constant of spring 2000 multiplied by the compression of this spring. However, when actuator 1800 is triggered and moved into its released position in the longitudinal portion 1900 (FIG. 19) of slot 1804 in base 1808 as shown in FIGS. 19 and 21, housing 1724 is now biased by both springs 2000, 2004 (assuming the longitudinal portion of slot 1804 is long enough to not interfere with activation of the second spring 2004). If springs 2000, 2004 have equal spring rates and are compressed the same amount, the effective force of housing 1724 on toe retainer 1712 remains the same as before but the combined spring rate is halved in this example. Of course, the spring constants, compression distances and other variables will be selected so that both the unreleased and attenuated release forces housing 1724 applies to toe retainer 1712 will be selected to achieve the desired results, which in the context of the present invention includes inhibiting ACL injuries. Referring to FIG. 18, it is noted that the right-leg set up of toe assembly 1700 (FIG. 17) can be changed to a left-leg setup by locating longitudinal portion 1900 (FIG. 19) of slot 1804 in base 1808 on the other side of transverse portion 1820.

Figure 22:
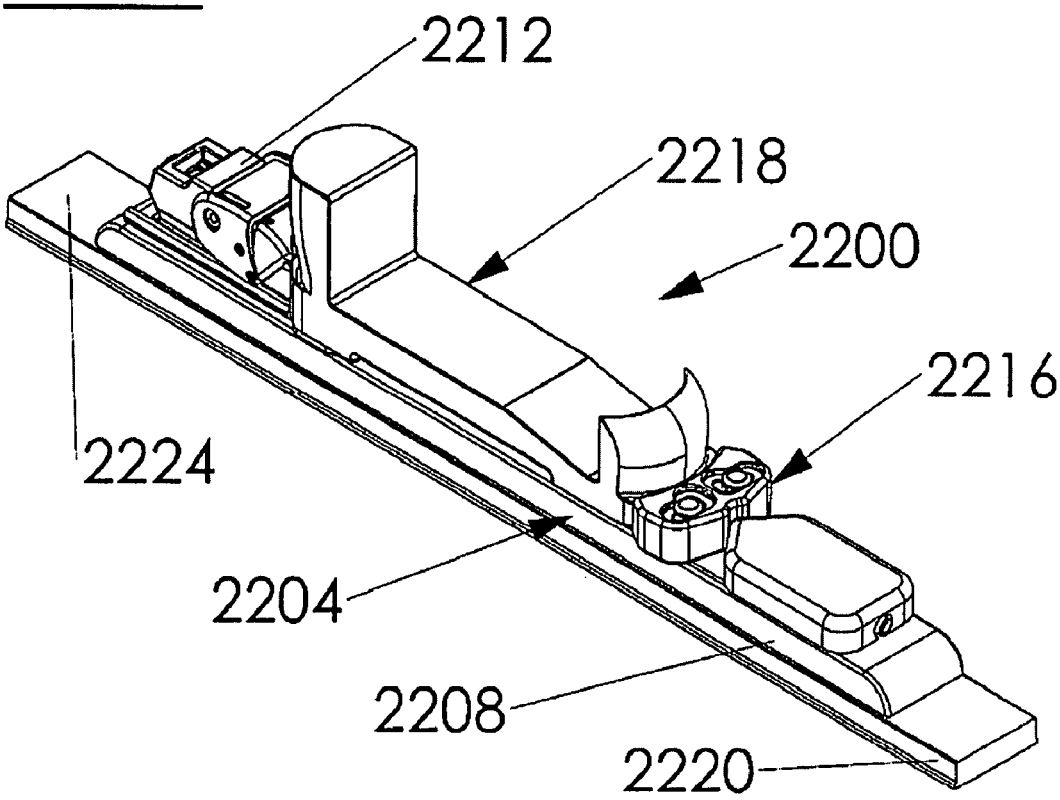
FIG. 22 is an isometric partial top view of a ski system that includes an electronic third-quadrant release-logic binding system.
Figure 23:
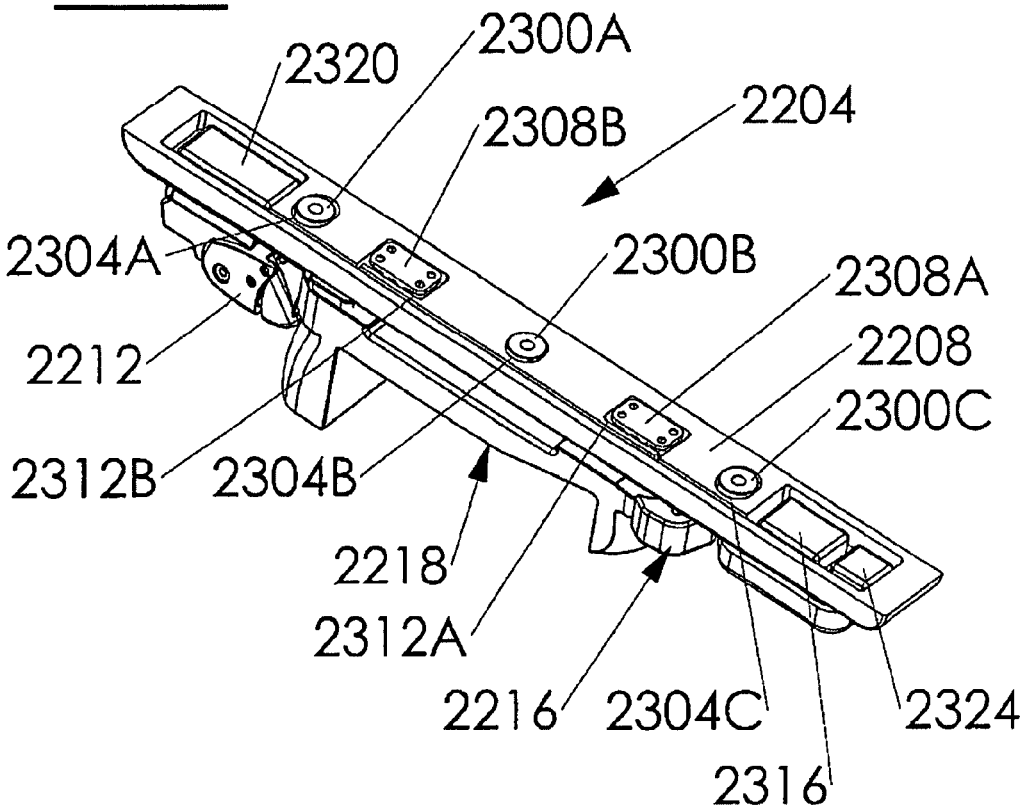
FIG. 23 is an isometric bottom view of the electronic third-quadrant release-logic binding system of FIG. 22.
Figure 24:
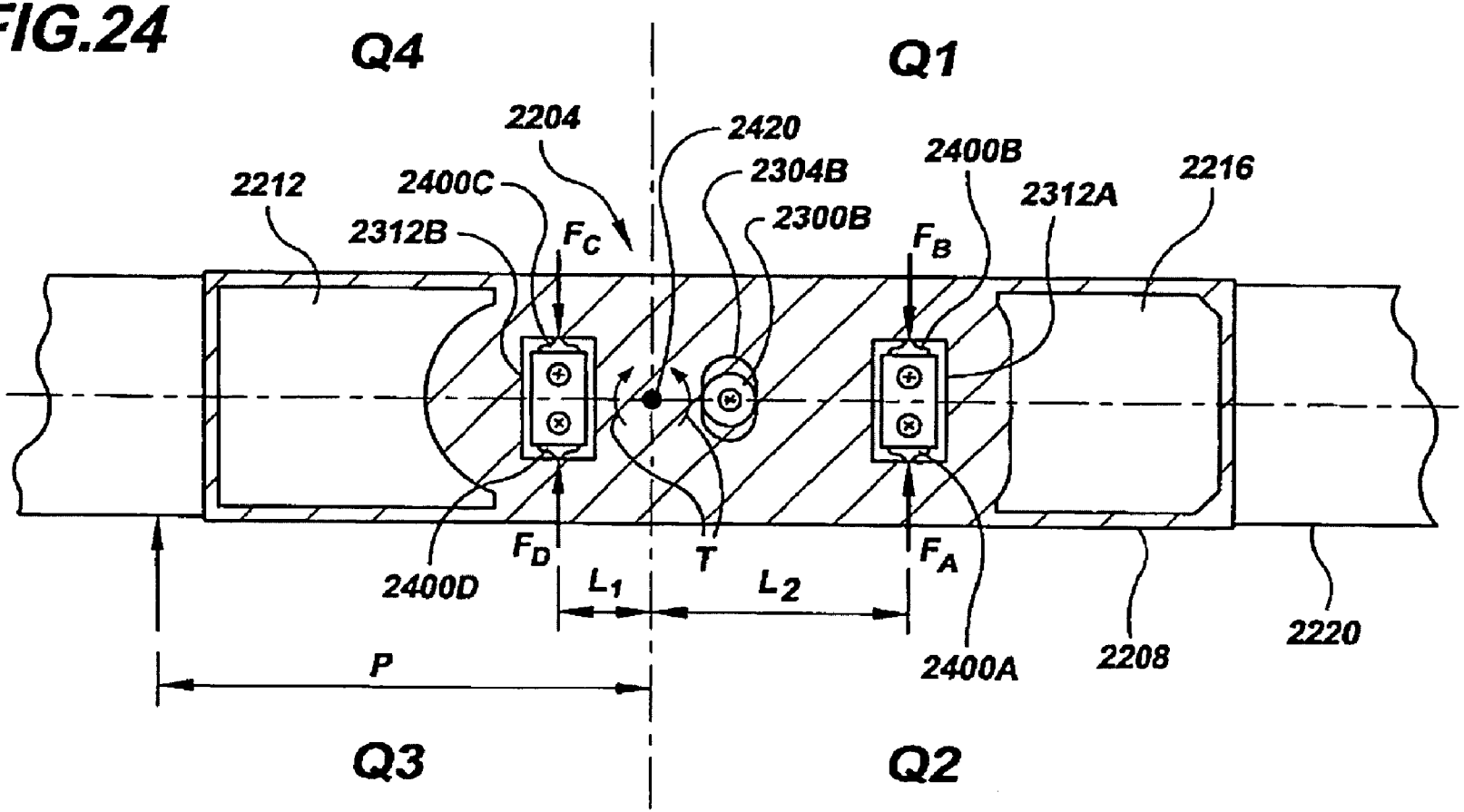
FIG. 24 is a partial top view/cross-sectional view/diagrammatic view of the electronic third-quadrant release-logic binding system of FIGS. 22 and 23 illustrating the operation of the binding.

Whereas the embodiments of FIGS. 9A-21 are generally purely mechanical in nature, the third-quadrant release logic described above in connection with FIGS. 1 and 5-9 can be implemented electronically using either a digital controller or an analog controller, or a combination of both. FIGS. 22-24 illustrate one example of a ski system 2200 that includes an electronic third-quadrant release-logic binding system 2204. Referring first to FIGS. 22 and 23, binding system 2204 includes a base 2208 that supports heel and toe pieces 2212, 2216. For context, a conventional ski boot sole 2218 is shown being clamped between heel and toe pieces 2212, 2216 as it would during an unreleased state of electronic binding system 2204. Base 2208 is secured to a ski 2220 so as to be substantially fixed in the fore and aft direction relative to the ski and also substantially fixed in a direction normal to the upper surface 2224 of the ski. However, base 2208 is secured to ski 2220 so as to be movable laterally relative to ski. In this example, base 2208 is secured using three studs 2300A-C that are fixed to ski 2220 and engage corresponding respective slots 2304A-C in the base. As those skilled in the art will appreciate, in this example studs 2304A, 2304C include a head (not shown) that engages base 2208 in a manner that inhibits movement of the base in a direction normal to upper surface 2224 of ski 2220.

Electronic binding system 2204 also includes at least two sensors for sensing information regarding the lateral (shear) forces being transmitted between base 2208 and ski 2220 at two distinct locations along the longitudinal axis of the ski. In this example, such sensors are two pairs of load cells 2400A-D (FIG. 24) that are fixed to ski 2200 by corresponding load cell supports 2300A-B (FIG. 23) and extend into corresponding respective cavities 2312A-B in base 2208. As is seen more particularly in FIG. 24 and as described below, with this arrangement, load cells 2400A-D are able to sense the lateral forces between base 2208 and ski 2220 at two distinct locations. In this example, each of heel and toe pieces 2212, 2216 is responsive to a trigger signal to cause a release of boot sole 2218. As those skilled in the art will readily appreciate, heel and toe pieces 2212, 2216 may release in any of a number of manners. In the example shown, heel piece 2212 releases the heel of ski boot 2218 vertically, whereas toe piece 2216 releases the toe of the ski boot by pivoting laterally, in the manner of toe assembly 1700 of FIGS. 17-21. Indeed, toe assembly 1700 of FIGS. 17-21 may readily be adapted for use with electronic binding system 2204 of FIGS. 22-24, by providing a suitable actuator 2316 (FIG. 23) for moving actuator 1800 (FIG. 18) of toe assembly 1700. Actuator 2316 of FIG. 23 may be any suitable electronic or electromechanical actuator. In this example, electronic binding system 2204 would also be provided with a suitable electronic or electromechanical actuator 2320 (FIG. 23) for activating the release of heel piece 2212. In other embodiments, toe piece 2216 may be replaced by a vertical-release toe piece (not shown) that releases vertically in the manner of heel piece 2212. In yet other embodiments, only toe piece 2216 or heel piece 2212 may provide the desired release.

Electronic binding system 2204 includes a controller 2324 for implementing the release logic. Controller 2324 may be either a digital controller that utilizes, for example, a microprocessor such as an application specific integrated circuit (not shown), or an analog computer, or a combination of both. Those skilled in the art understanding the release logic of electronic binding system 2204 will readily be able to implement a suitable controller 2324 without undue experimentation. Similarly, those skilled in the art will readily understand how to implement all communications required between/among actuators 2316, 2320, sensors 2400A-D and controller 2324 using any suitable wired or wireless technology, or a combination of both. Therefore, such details are not presented in FIGS. 22-24.

Referring now to FIG. 24, this figure is used to explain the release logic used by electronic binding system 2204, and particularly controller 2324, to release heel and toe pieces 2212, 2216 with an attenuated release in response to virtual forces Fy in quadrant 3 that exceed a predetermined trigger trip threshold. Of course, the release logic in the other quadrants 1, 2 and 4 may be programmed so that heel and/or toe pieces 2212, 2216 provide an appropriate non-attenuated release relative to the third-quadrant attenuated release. In FIG. 24, base 2208 is shown in cross-section to expose load cells 2400A-D and corresponding cavities 2304A-B and ski 2208 is shown for context.

For consistency with the analyses corresponding to FIGS. 1-8 and with the implementations of the embodiments of FIGS. 9A-21, the reference axis used for the release logic of electronic binding 2204 is the tibial axis 2420. With this reference, the torque T (which is equivalent to Mz in the context of FIGS. 1-8, above) about tibial axis 2420 is $T=T_1+T_2$. Since only one load cell 2400A-D in each of cavities 2304A-B can be loaded (with a compressive load) at a time, the output forces $F_A$, $F_B$ of load cells 2400A, 2400B can be added, and the output forces $F_C$, $F_D$ of load cells 2400C, 2400D can be added such that $F_A+F_B=F_2$ and $F_C+F_D=F_1$. Therefore, $T=(L_1\times F_1)+(L_2\times F_2)$, where $L_1$ is the distance between tibial axis 2420 and the transverse (relative to ski 2220) centerline of load cells 2400C, 2400D and $L_2$ is the distance between the tibial axis and the transverse centerline of load cells 2400A, 2400B. The virtual force Fy on ski 2220 is the sum of $F_1$ and $F_2$, i.e., $Fy=F_1+F_2$, and the position, P, of the virtual force Fy relative to tibial axis 2420 is determined by $P=T/Fy$.

As will be appreciated, the quadrant of virtual force Fy is determined by the signs of position P and torque T. Here, for quadrant 3, position P is negative and torque is positive. For the attenuated quadrant 3 release, the attenuated release logic of controller 2324 is designed to trigger actuators 2316, 2320 when the value of calculated torque T exceeds the value of the predetermined release torque calculated from the appropriate equations for the trigger trip torque and attenuated release torque, which are represented graphically for one example in FIG. 7, above. In other words, if T is greater than both the trigger trip torque and the attenuated release torque, then controller 2324 will send a release signal to actuators 2316, 2320. This same procedure can be used in all other quadrants with as much complexity as is required to satisfy the desired retention threshold in each quadrant. The raw forces $F_1$ and $F_2$ can be sampled and filtered to best predict the true loads on the lower extremities of a skier using ski system 2200 (FIG. 22). A mechanical spring (not shown) may, for example, be used in series with each of load cells 2400A-D to filter out very short duration loads that likely do not impact ACL injury.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A ski binding configured to be secured to a snow ski and selectively retain a ski boot having a heel and a toe and worn by a skier having a tibial axis, the snow ski having a first-quadrant, a second-quadrant, a third-quadrant, a fourth-quadrant and a trailing end, the ski binding comprising:

a heel piece for releasably engaging the heel of the ski boot;

a toe piece for releasably engaging the toe of the ski boot, wherein said toe piece and said heel piece provide the ski binding with a non-attenuated release torque about the tibial axis of the skier when:

the ski binding is mounted to the snow ski;

the skier is wearing the ski boot; and the ski boot is properly captured in the ski binding; and release logic providing the ski binding with an attenuated release torque about the tibial axis in response substantially only to a lateral shear force being applied to the snow ski at a location in the third-quadrant.

2. The ski binding of claim 1, wherein, when the ski binding is mounted to the snow ski, the skier is wearing the ski boot and the ski boot is properly captured in the ski binding, said attenuated release torque induces a tibial torque about the tibial axis of the skier, said release logic configured so that the tibial torque is diminished as a function of the location of the lateral shear force in the third-quadrant from the tibial axis toward the trailing end of the snow ski.

3. The ski binding of claim 1, wherein said release logic comprises a trigger and a secondary toe release responsive to said trigger so as to release the toe of the ski when the ski binding is mounted to the snow ski, the skier is wearing the ski boot and the ski boot is properly captured in the ski binding, said trigger being triggerable in response substantially only to a lateral shear force being applied to the snow ski at a location in the third-quadrant of the snow ski.

4. The ski binding of claim 3, wherein said trigger comprises a trigger mechanism and a trigger trip torque mechanism for providing said trigger mechanism with a trip torque threshold for substantially only lateral shear forces applied at locations in the third-quadrant of the snow ski.

5. The ski binding of claim 4, wherein said trigger mechanism includes, when the ski binding is secured to the snow ski, a trigger member pivotably secured to the snow ski and having a pivot point located forward of the toe of the boot when the boot is properly engaged with the snow ski.

6. The ski binding of claim 5, wherein said trigger mechanism further includes a pivotable latch releasably securing said secondary toe release, said pivotable latch pivotably secured to said trigger member.

7. The ski binding of claim 6, wherein said pivotable latch is actuated by pivoting of said trigger member relative to said ski about said pivot point.

8. The ski binding of claim 5, wherein said trigger mechanism further includes a movable catch releasably securing said secondary toe release, said movable catch movable in response to said trigger member being pivoted about said pivot point.

9. The ski binding of claim 5, wherein said trigger trip torque mechanism includes a biasing member biased between the snow ski and said trigger member so as to provide the trip torque threshold when the ski binding is affixed to the snow ski.

10. The ski binding of claim 5, wherein said trigger trip torque mechanism includes a biased toggle that includes a lever arm functionally engaging said trigger member.

11. The ski binding of claim 10, wherein, when said trigger member is in an unreleased state, said biased toggle is biased against a pair of fulcrums spaced from one another and, when said trigger member is in a release state, said biased toggle is pivoted about one or the other of said pair of fulcrums.

12. The ski binding of claim 11, wherein said trigger trip torque mechanism includes a locking pin for allowing said biased fulcrum to pivot substantially only about one of said pair of fulcrums.

13. The ski binding of claim 3, wherein said secondary toe release includes a secondary toe release mechanism that, when the ski boot is properly secured in the ski binding, provides the toe of the ski boot with an attenuated release in response to a lateral shear force being applied to the snow ski at a location in the third-quadrant of the snow ski.

14. The ski binding of claim 13, wherein said trigger includes, when the ski binding is secured to the snow ski, a trigger member pivotably secured to the snow ski and has a first pivot point located forward of the toe of the boot when the boot is properly engaged with the snow ski, said secondary toe release mechanism secured to said trigger member.

15. The ski binding of claim 14, wherein said secondary toe release mechanism includes a toe piece support plate pivotably secured to said trigger member, said toe piece being fixedly secured to said toe piece support plate.

16. The ski binding of claim 15, wherein said toe piece support plate has a second pivot point located between said first pivot point of said trigger member and the toe of the ski boot when the ski boot is properly engaged in the ski binding.

17. The ski binding of claim 15, wherein said secondary toe release mechanism includes a catch fixed relative to said toe piece support plate, said trigger including a movable latch for releasably engaging said catch.

18. The ski binding of claim 15, wherein said secondary toe release mechanism includes a latch fixed relative to said toe piece support plate, said trigger including a movable catch for releasably engaging said latch.

19. The ski binding of claim 15, further comprising an attenuated release threshold mechanism providing said secondary toe release with an attenuated release threshold.

20. The ski binding of claim 19, wherein said attenuated release threshold mechanism includes a biasing member biased between said trigger member and said toe piece support plate so as to provide said attenuated release threshold.

21. The ski binding of claim 19, wherein said secondary toe release includes a latch fixed relative to said toe piece support plate and including a cam follower, said attenuated release threshold mechanism including a biased cam biased into engagement with said cam follower of said latch.

22. The ski binding of claim 14, wherein said secondary toe release mechanism includes a toe assembly configured to selectively provide a non-attenuated toe release and an attenuated toe release in response to a triggering of said trigger.

23. The ski binding of claim 22, wherein said toe assembly includes a base, a toe retainer movable secured to said base, and a movable member biased against said toe retainer.

24. The ski binding of claim 23, wherein said toe assembly further includes a first spring, a second spring in series with said first spring and a movable actuator movable so as to 1) cause only said first spring to be active in biasing said movable member against said toe retainer and 2) cause both said first and second springs to be active in biasing said movable member against said toe retainer depending on the position of said movable actuator, said movable actuator being movable in response to a triggering of said trigger.

25. The ski binding of claim 1, wherein the attenuated release torque is at least 20% less than the non-attenuated release torque.

26. The ski binding of claim 1, wherein said release logic is configured to provide the non-attenuated release torque for lateral shear forces applied in the fourth-quadrant of the snow ski.

27. The ski binding of claim 1, further comprising:

one or more sensors for obtaining information for determining forces being transmitted between a skier and a ski when the binding is secured to the ski and the ski binding is secured to the skier;

an electronic controller in communication with said one or more sensors, said electronic controller configured to generate a third-quadrant attenuated release signal in response to a virtual loading applied in the third-quadrant;

at least one actuator operatively connected to said toe piece or said heel piece, or both, said at least one actuator being responsive to the third-quadrant attenuated release signal.

28. The ski binding of claim 27, wherein said electronic controller is configured to generate the third-quadrant attenuated release signal as a function of a tibial torque about a tibial axis of a skier, a net virtual force and a position of the net virtual force relative to the tibial axis.

29. The ski binding of claim 28, further comprising:

a base supporting said heel and toe pieces and laterally movably securable to a ski;

a first pair of load cells spaced from the tibial axis; and a second pair of load cells spaced from the tibial axis so that the tibial axis is located between said first and second pairs of load cells, said first and second pairs of load cells for sensing lateral forces between said base and the ski when the ski binding is secured to a ski and a skier is skiing with the ski binding and providing force data to said controller;

wherein said controller is configured to generate the third-quadrant attenuated release signal as a function of the force data from said first and second plurality of load cells.

30. An apparatus for securing a ski boot to a ski so as to from a ski system, the apparatus comprising:

a ski binding assembly configured to be attached to the ski and to releasably secure the ski boot to the ski during use, said ski binding assembly having a first release, said ski binding assembly including release logic that causes the ski binding assembly to release the ski boot at said first release in response to a release condition, said ski binding assembly configured to:

assess, relative to a first axis, a first loading internal to the ski system caused by an external loading applied to the ski system; and assess, relative to a second axis spaced from said first axis and substantially parallel to said first axis, a second loading internal to the ski system caused by the external loading;

wherein said release logic is configured to:

determine whether or not the release condition is occurring as a function of both of the first loading and the second loading; and cause said ski binding assembly to provide said first release if the release logic determines that the release condition is occurring;

wherein said ski binding assembly is configured to determine a force-couple at a third axis from said first loading and said second loading, and said release logic is configured to determine whether or not the release condition is occurring as a function of the force-couple.

31. An apparatus according to claim 30, wherein said third axis is substantially coincident with a tibial axis of a user when the user is wearing the ski boot and the ski boot is releasably engaged in the binding assembly.

32. An apparatus according to claim 30, wherein said first loading is a first shear force on said first axis and said second loading is a second shear force on said second axis, and said ski binding assembly is configured to determine the force-couple from the first shear force and the second shear force.

33. An apparatus according to claim 30, wherein said first loading is a shear force on said first axis and said second loading is a moment on said second axis, and said ski binding assembly is configured to determine the force-couple from the shear force and the moment.

34. An apparatus according to claim 30, wherein said first loading is a first moment on said first axis and said second loading is a second moment on said second axis, and said ski binding assembly is configured to determine the force-couple from the first moment and the second moment.

35. An apparatus according to claim 30, wherein said ski binding assembly has a second release, said first release being an attenuated release relative to said second release.

36. An apparatus according to claim 35, wherein said first release is at least 20% less than said second release.

37. An apparatus according to claim 35, wherein said first release is a first release torque about a tibial axis of a skier when the skier is wearing the ski boot and the ski boot is secured to the ski by said ski binding assembly and said second release is a second release torque about a tibial axis of a skier when the skier is wearing the ski boot and the ski boot is secured to the ski by said ski binding assembly.

38. An apparatus according to claim 37, wherein said first release torque is at least 20% less than said second release torque.

39. An apparatus according to claim 35, wherein:

the ski boot has a toe and a heel and is worn by a skier having a tibial axis; and the ski has a first-quadrant, a second-quadrant, a third-quadrant, a fourth-quadrant and a trailing end;

said ski binding assembly including:

a heel piece for releasably engaging the heel of the ski boot; and a toe piece for releasably engaging the toe of the ski boot, wherein said toe piece and said heel piece provide the ski binding with a non-attenuated release torque about the tibial axis of the skier when:

said ski binding assembly is mounted to the ski;

the skier is wearing the ski boot; and the ski boot is properly captured in said ski binding assembly;

wherein said release logic provides said ski binding assembly with an attenuated release torque about the tibial axis in response substantially only to a lateral shear force being applied to the snow ski at a location in the third-quadrant.

40. An apparatus according to claim 39, wherein said release logic comprises a trigger and a secondary toe release responsive to said trigger so as to release the toe of the ski when said ski binding assembly is mounted to the ski, the skier is wearing the ski boot and the ski boot is properly captured in said ski binding assembly, said trigger being triggerable in response substantially only to a lateral shear force being applied to the ski at a location in the third-quadrant of the snow ski.

41. An apparatus according to claim 39, further comprising:

one or more sensors for obtaining information for determining forces being transmitted between a skier and the ski when said ski binding assembly is secured to the ski and said ski binding assembly is secured to the skier;

an electronic controller in communication with said one or more sensors, said electronic controller configured to generate a third-quadrant attenuated release signal in response to a virtual loading applied in the third-quadrant; and at least one actuator operatively connected to said toe piece or said heel piece, or both, said at least one actuator being responsive to the third-quadrant attenuated release signal.

42. An apparatus for securing a ski boot to a ski so as to form a ski system, the apparatus comprising:

a ski binding assembly configured to be attached to the ski and to releasably secure the ski boot to the ski during use, said ski binding assembly having a first release, said ski binding assembly including release logic that causes the ski binding assembly to release the ski boot at said first release, said release logic set to activate said first release substantially only when:

a first loading, internal to the ski system along or about a first axis and caused by an external loading applied to the ski system, exceeds a first defined level and has a first defined sense; and a second loading, internal to the ski system along or about a second axis and caused by the external loading, exceeds a second defined level and has a second defined sense;

wherein the ski system has a first-quadrant, a second-quadrant, a third-quadrant and a fourth-quadrant and the external loading resolves into a single virtual lateral shear force on the ski, said release logic set to activate said first release substantially only when the single virtual lateral shear force is located within the third-quadrant.

43. An apparatus according to claim 42, wherein said first and second axes are spaced from, and substantially parallel to, one another.

44. An apparatus according to claim 42, wherein said first loading is a first force and said second loading is a second force parallel to, and spaced from, said first force.

45. An apparatus according to claim 42, wherein said first loading is a force and said second loading is a moment.

46. An apparatus according to claim 42, wherein said first loading is a first moment and said second loading is a second moment and said first and second axes are spaced from, and substantially parallel to, one another.

47. An apparatus according to claim 42, wherein said ski binding assembly has a second release, said first release being an attenuated release relative to said second release.

48. An apparatus according to claim 47, wherein said first release is a first release torque about a tibial axis of a skier when the skier is wearing the ski boot and the ski boot is secured to the ski by said ski binding assembly and said second release is a second release torque about a tibial axis of a skier when the skier is wearing the ski boot and the ski boot is secured to the ski by said ski binding assembly.

49. An apparatus according to claim 48, wherein said first release torque is at least 20% less than said second release torque.

50. An apparatus according to claim 47, wherein:

the ski boot has a toe and a heel and is worn by a skier having a tibial axis; and the ski has a first-quadrant, a second-quadrant, a third-quadrant, a fourth-quadrant and a trailing end;

said ski binding assembly including:

a heel piece for releasably engaging the heel of the ski boot; and a toe piece for releasably engaging the toe of the ski boot, wherein said toe piece and said heel piece provide the ski binding with a non-attenuated release torque about the tibial axis of the skier when:

said ski binding assembly is mounted to the ski;

the skier is wearing the ski boot; and the ski boot is properly captured in said ski binding assembly;

wherein said release logic provides said ski binding assembly with an attenuated release torque about the tibial axis in response substantially only to a lateral shear force being applied to the snow ski at a location in the third-quadrant.

51. An apparatus according to claim 50, wherein said release logic comprises a trigger and a secondary toe release responsive to said trigger so as to release the toe of the ski when said ski binding assembly is mounted to the ski, the skier is wearing the ski boot and the ski boot is properly captured in said ski binding assembly, said trigger being triggerable in response substantially only to a lateral shear force being applied to the ski at a location in the third-quadrant of the snow ski.

52. An apparatus according to claim 51, further comprising:

one or more sensors for obtaining information for determining forces being transmitted between a skier and the ski when said ski binding assembly is secured to the ski and said ski binding assembly is secured to the skier;

an electronic controller in communication with said one or more sensors, said electronic controller configured to generate a third-quadrant attenuated release signal in response to a virtual loading applied in the third-quadrant; and at least one actuator operatively connected to said toe piece or said heel piece, or both, said at least one actuator being responsive to the third-quadrant attenuated release signal.

53. An apparatus for securing a ski boot to a ski so as to form a ski system, the apparatus comprising:

a ski binding assembly configured to be attached to the ski and to releasably secure the ski boot to the ski during use, said ski binding assembly having a first release, said ski binding assembly including release logic that causes the ski binding assembly to release the ski boot at said first release in response to a release condition, said ski binding assembly configured to:

assess, relative to a first axis, a first loading internal to the ski system caused by an external loading applied to the ski system; and assess, relative to a second axis spaced from said first axis and substantially parallel to said first axis, a second loading internal to the ski system caused by the external loading;

wherein said release logic is configured to:

determine whether or not the release condition is occurring as a function of both of the first loading and the second loading; and cause said ski binding assembly to provide said first release if the release logic determines that the release condition is occurring;

wherein said ski binding assembly has a second release, said first release being an attenuated release relative to said second release.

54. An apparatus according to claim 53, wherein said first release is at least 20% less than said second release.

55. An apparatus according to claim 53, wherein said first release is a first release torque about a tibial axis of a skier when the skier is wearing the ski boot and the ski boot is secured to the ski by said ski binding assembly and said second release is a second release torque about a tibial axis of a skier when the skier is wearing the ski boot and the ski boot is secured to the ski by said ski binding assembly.

56. An apparatus according to claim 55, wherein said first release torque is at least 20% less than said second release torque.

57. An apparatus according to claim 53, wherein:

the ski boot has a toe and a heel and is worn by a skier having a tibial axis; and the ski has a first-quadrant a second-quadrant, a third-quadrant, a fourth-quadrant and a trailing end;

said ski binding assembly including:

a heel piece for releasably engaging the heel of the ski boot; and a toe piece for releasably engaging the toe of the ski boot, wherein said toe piece and said heel piece provide the ski binding with a non-attenuated release torque about the tibial axis of the skier when:

said ski binding assembly is mounted to the ski;

the skier is wearing the ski boot; and the ski boot is properly captured in said ski binding assembly;

wherein said release logic provides said ski binding assembly with an attenuated release torque about the tibial axis in response substantially only to a lateral shear force being applied to the snow ski at a location in the third-quadrant.

58. An apparatus for securing a ski boot to a ski so as to form a ski system, the apparatus comprising:

a ski binding assembly configured to be attached to the ski and to releasably secure the ski boot to the ski during use, said ski binding assembly having a first release, said ski binding assembly including release logic that causes the ski binding assembly to release the ski boot at said first release, said release logic set to activate said first release substantially only when:

a first loading, internal to the ski system along or about a first axis and caused by an external loading applied to the ski system, exceeds a first defined level and has a first defined sense; and a second loading, internal to the ski system along or about a second axis and caused by the external loading, exceeds a second defined level and has a second defined sense;

wherein said ski binding assembly has a second release, said first release being an attenuated release relative to said second release.

59. An apparatus according to claim 58, wherein said first release is a first release torque about a tibial axis of a skier when the skier is wearing the ski boot and the ski boot is secured to the ski by said ski binding assembly and said second release is a second release torque about a tibial axis of a skier when the skier is wearing the ski boot and the ski boot is secured to the ski by said ski binding assembly.

60. An apparatus according to claim 59, wherein said first release torque is at least 20% less than said second release torque.

61. An apparatus according to claim 58, wherein:

the ski boot has a toe and a heel and is worn by a skier having a tibial axis; and the ski has a first-quadrant, a second-quadrant, a third-quadrant, a fourth-quadrant and a trailing end;

said ski binding assembly including:

a heel piece for releasably engaging the heel of the ski boot; and a toe piece for releasably engaging the toe of the ski boot, wherein said toe piece and said heel piece provide the ski binding with a non-attenuated release torque about the tibial axis of the skier when:

said ski binding assembly is mounted to the ski;

the skier is wearing the ski boot; and the ski boot is properly captured in said ski binding assembly;

wherein said release logic provides said ski binding assembly with an attenuated release torque about the tibial axis in response substantially only to a lateral shear force being applied to the snow ski at a location in the third-quadrant.

* * * * *